US011963599B2

(12) United States Patent
Lee

(10) Patent No.: US 11,963,599 B2
(45) **Date of Patent: *Apr. 23, 2024**

(54) COSMETIC CONTAINER

(71) Applicants: LG HOUSEHOLD & HEALTH CARE LTD., Seoul (KR); LG ELECTRONICS INC., Seoul (KR)

(72) Inventor: Dong Hyun Lee, Seoul (KR)

(73) Assignees: LG HOUSEHOLD & HEALTH CARE LTD., Seoul (KR); LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/889,939

(22) Filed: Aug. 17, 2022

(65) Prior Publication Data

US 2022/0386755 A1 Dec. 8, 2022

Related U.S. Application Data

(62) Division of application No. 16/623,689, filed as application No. PCT/KR2018/009135 on Aug. 9, 2018, now Pat. No. 11,464,314.

(30) Foreign Application Priority Data

Aug. 11, 2017 (KR) ..... 10-2017-0102537

(51) Int. Cl.

| | |
|---|---|
| ***A45D 34/04*** | (2006.01) |
| ***B65D 43/16*** | (2006.01) |
| ***B65D 43/22*** | (2006.01) |

(52) U.S. Cl.

CPC ..... *A45D 34/04* (2013.01); *B65D 43/16* (2013.01); *B65D 43/22* (2013.01); *A45D 2200/056* (2013.01)

(58) Field of Classification Search

CPC .. A45D 34/04; A45D 2200/056; B65D 43/16; B65D 43/22

See application file for complete search history.

(56) References Cited

U.S. PATENT DOCUMENTS

| | | | | |
|---|---|---|---|---|
| 9,296,532 | B2 | 3/2016 | Coloneri et al. | |
| 10,010,153 | B2 | 7/2018 | Kim et al. | |
| 10,104,951 | B2 | 10/2018 | Lee | |
| 10,524,558 | B2 * | 1/2020 | Oh | A45D 40/22 |
| 10,869,534 | B2 | 12/2020 | Kim et al. | |
| 2011/0297704 | A1 * | 12/2011 | Esteve | A45D 34/00 222/405 |

(Continued)

FOREIGN PATENT DOCUMENTS

| | | | |
|---|---|---|---|
| CN | 204444652 | U | 7/2015 |
| CN | 204682840 | U | 10/2015 |

(Continued)

OTHER PUBLICATIONS

Office Action issued in KR 10-2017-0102537 dated May 18, 2018.
Office Action issued in KR 10-2018-7026280 dated Dec. 6, 2019.
Office Action issued in TW 107128093 dated Aug. 6, 2019.

*Primary Examiner* — Jeremy Carroll

(74) *Attorney, Agent, or Firm* — Birch, Stewart, Kolasch & Birch, LLP

(57) ABSTRACT

A cosmetic container according to an embodiment of the present invention may reduce a thickness of the container by improving a structure of the disc valve.

19 Claims, 41 Drawing Sheets

(56) References Cited

U.S. PATENT DOCUMENTS

| | | | | |
|---|---|---|---|---|
| 2014/0231454 | A1 | 8/2014 | Rossignol | |
| 2016/0242529 | A1* | 8/2016 | Oh | A45D 33/006 |
| 2016/0242530 | A1 | 8/2016 | Son et al. | |
| 2017/0056905 | A1 | 3/2017 | Lee | |
| 2017/0095055 | A1 | 4/2017 | Chung | |
| 2017/0273437 | A1 | 9/2017 | Kim | |
| 2017/0354230 | A1* | 12/2017 | Oh | B05B 1/18 |
| 2018/0035785 | A1 | 2/2018 | Lee | |
| 2018/0184786 | A1* | 7/2018 | Lee | A45D 40/00 |
| 2018/0207658 | A1 | 7/2018 | Lee | |
| 2020/0029673 | A1* | 1/2020 | Kase | A45D 33/006 |
| 2020/0054113 | A1* | 2/2020 | Oh | B05B 1/18 |
| 2020/0170375 | A1 | 8/2020 | Lee | |

FOREIGN PATENT DOCUMENTS

| | | | |
|---|---|---|---|
| CN | 105101834 | A | 11/2015 |
| CN | 205125401 | U | 4/2016 |
| CN | 105873833 | A | 8/2016 |
| CN | 205612014 | U | 10/2016 |
| CN | 106175032 | A | 12/2016 |
| CN | 205884978 | U | 1/2017 |
| CN | 106923475 | A | 7/2017 |
| CN | 105658109 | A | 6/2018 |
| CN | 205432578 | U | 8/2018 |
| JP | 60-50910 | U | 4/1985 |
| JP | 2008-132013 | A | 6/2008 |
| JP | 2016-123845 | A | 7/2016 |
| JP | 2016-534761 | A | 11/2016 |
| KR | 91-14993 | U | 9/1991 |
| KR | 1994-0001931 | Y1 | 3/1994 |
| KR | 20-2013-0006083 | U | 10/2013 |
| KR | 10-1449661 | B1 | 10/2014 |
| KR | 20-2014-0005620 | U | 10/2014 |
| KR | 10-1471339 | B1 | 12/2014 |
| KR | 10-2015-0086445 | A | 7/2015 |
| KR | 10-2015-0088039 | A | 7/2015 |
| KR | 10-2016-0005242 | A | 1/2016 |
| KR | 10-1585394 | B1 | 1/2016 |
| KR | 10-2016-0046654 | A | 4/2016 |
| KR | 10-1610025 | B1 | 4/2016 |
| KR | 10-2016-0093352 | A | 8/2016 |
| KR | 10-1678354 | B1 | 11/2016 |
| KR | 10-2016-0149395 | A | 12/2016 |
| KR | 20-2017-0000470 | U | 2/2017 |
| KR | 10-1720903 | B1 | 3/2017 |
| KR | 10-2017-0065259 | A | 6/2017 |
| KR | 10-2017-0096527 | A | 8/2017 |
| KR | 10-2018-0092920 | A | 8/2018 |
| KR | 10-2019-0142439 | A | 12/2019 |
| WO | WO 2016/208860 | A1 | 12/2016 |
| WO | WO 2016/208928 | A1 | 12/2016 |
| WO | WO 2017/022996 | A1 | 2/2017 |
| WO | WO 2017/105093 | A1 | 6/2017 |
| WO | WO 2016/043370 | A1 | 3/2018 |

* cited by examiner

【Fig. 1】
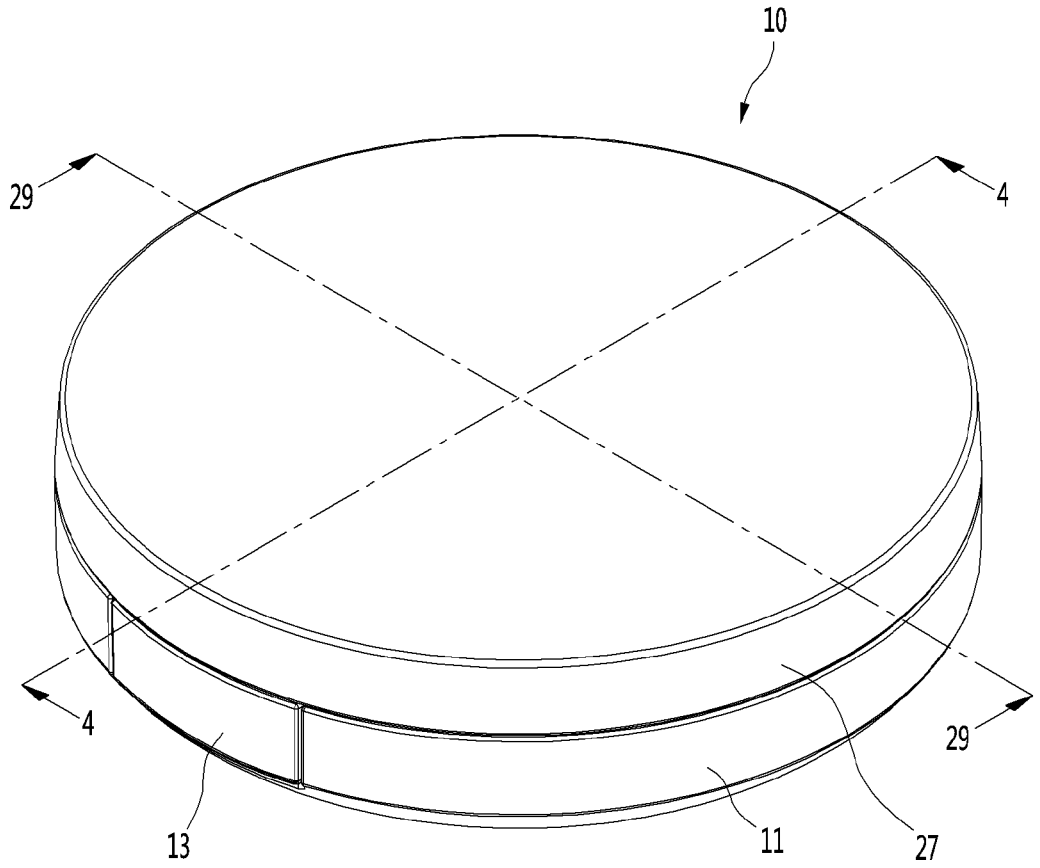

【Fig. 2】
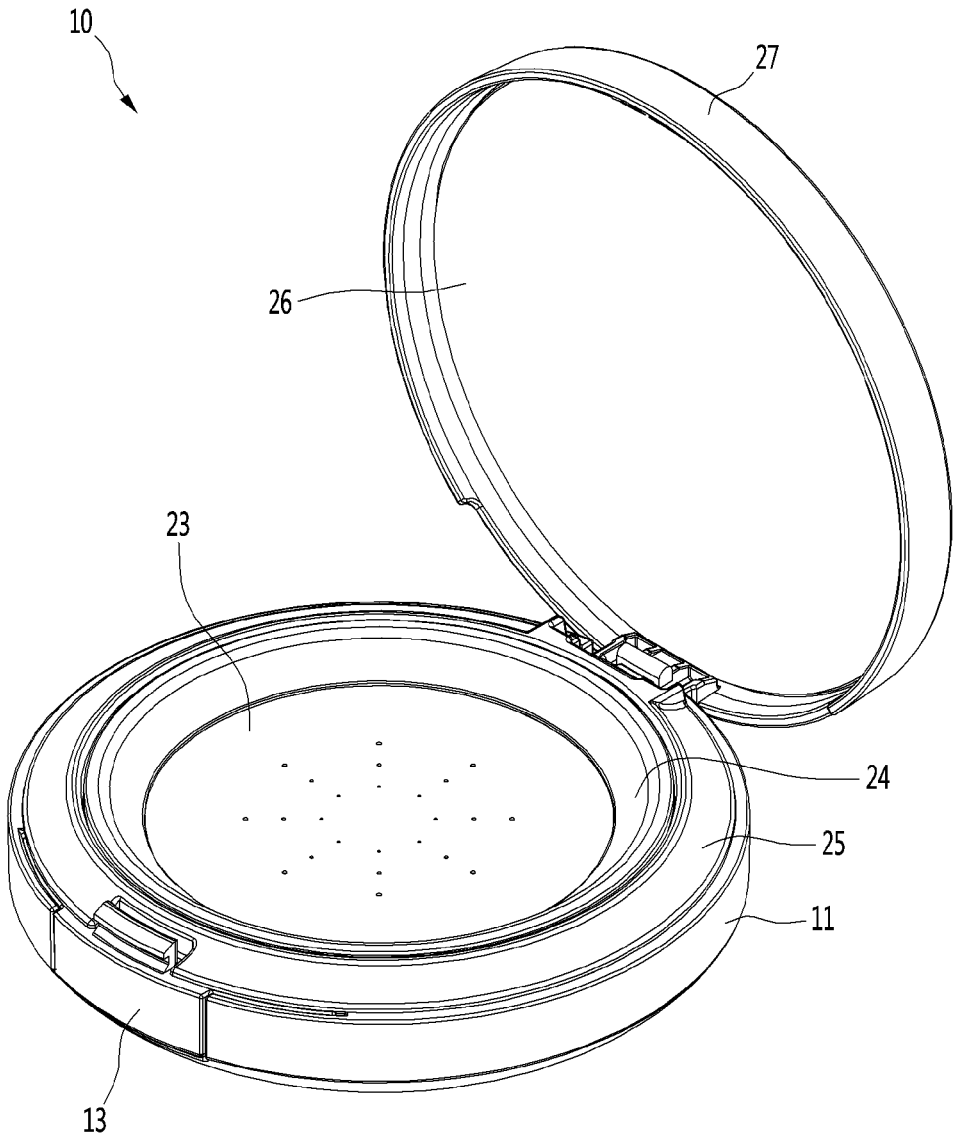

【Fig. 3】
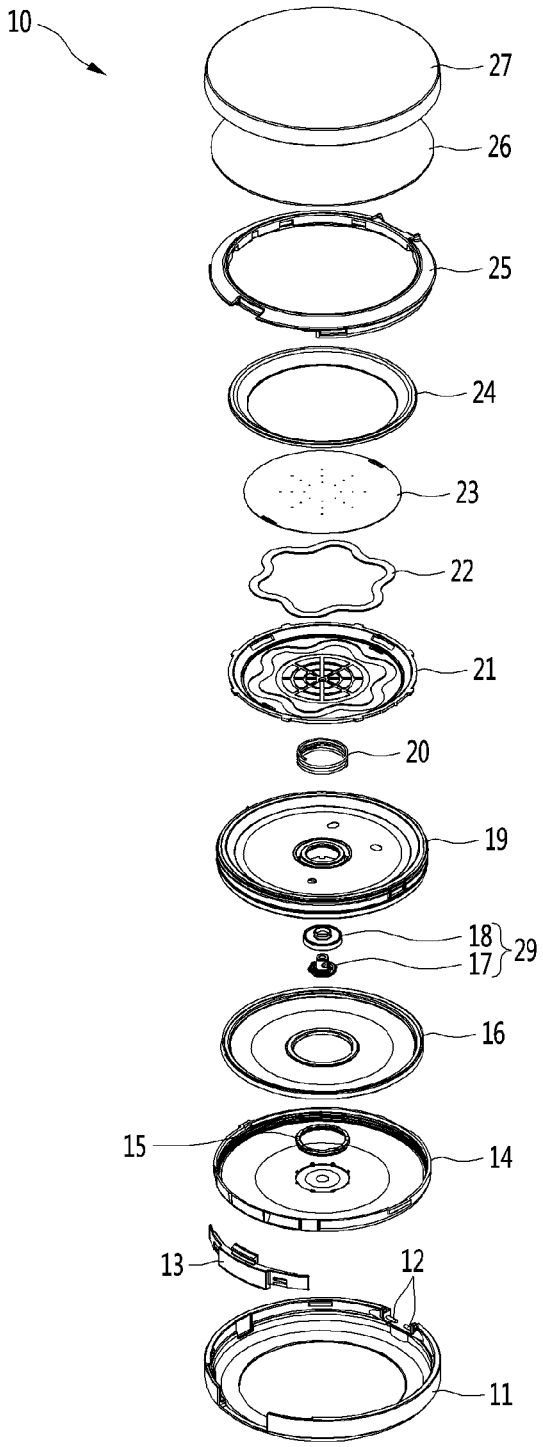

【Fig. 4】
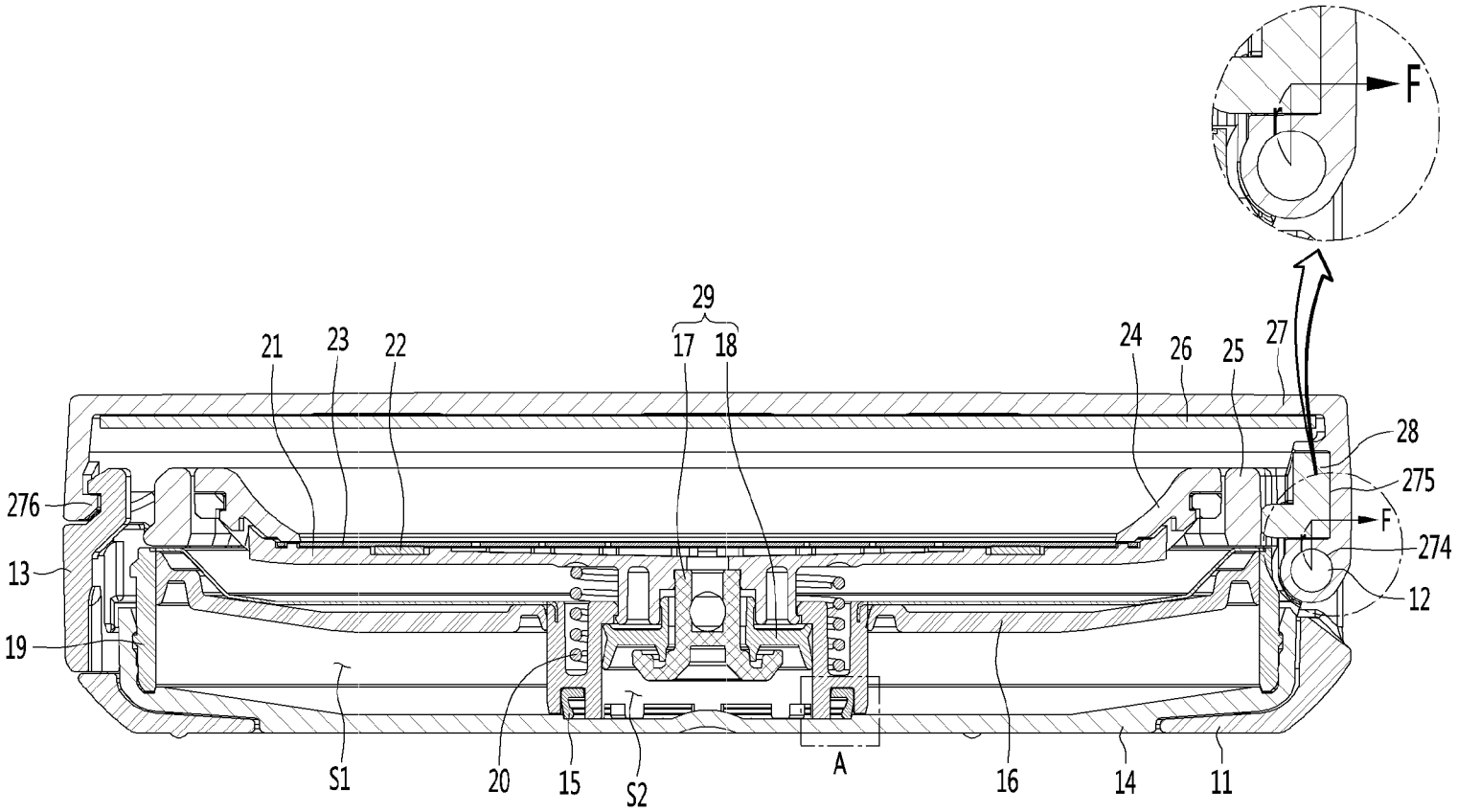

【Fig. 5】
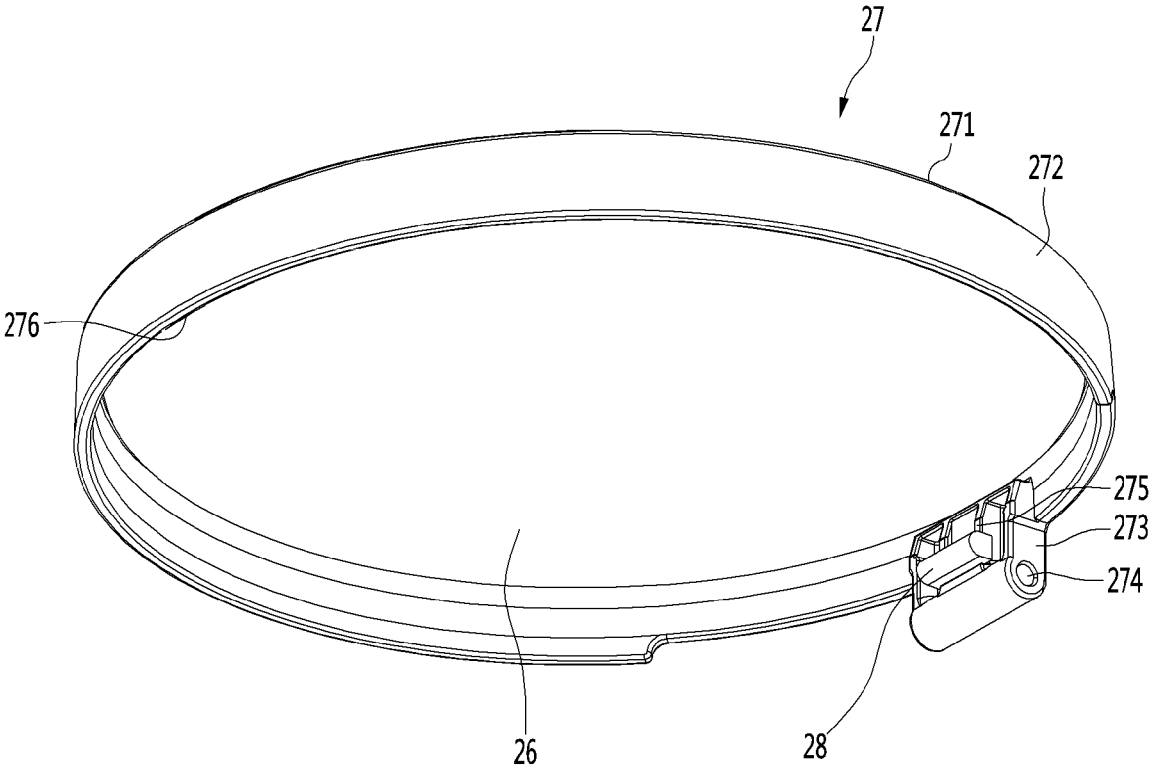

【Fig. 6】
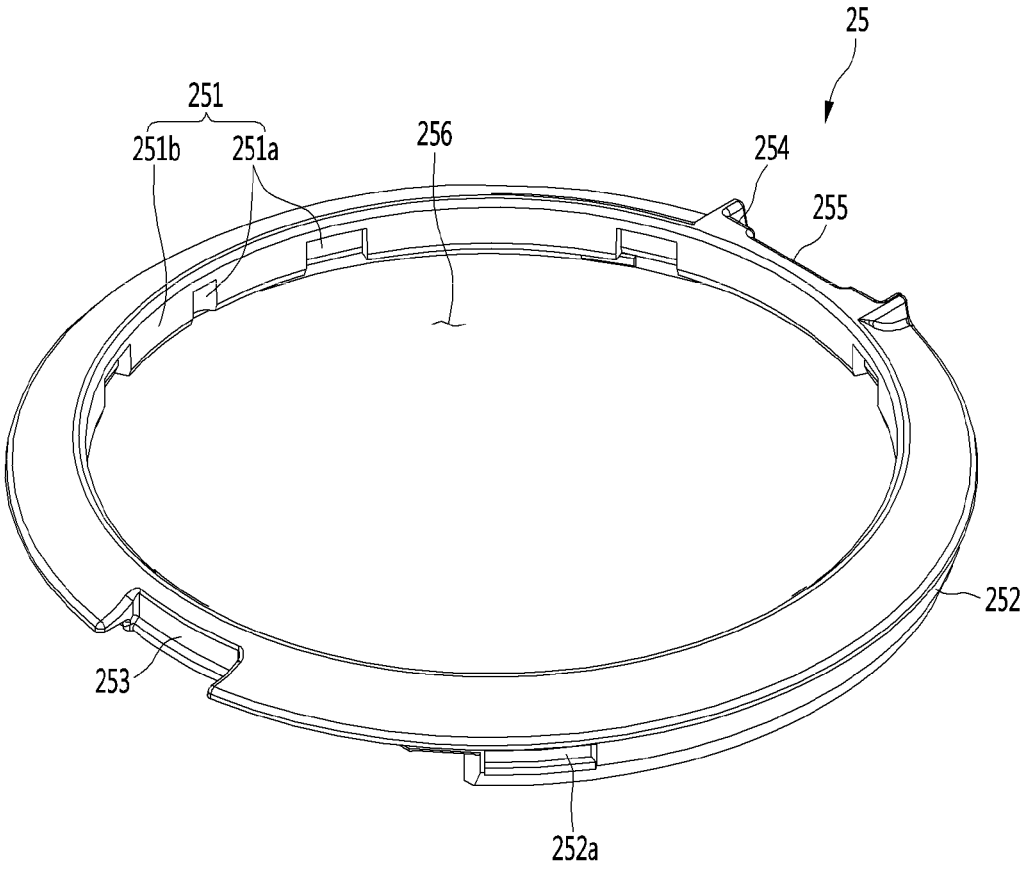

【Fig. 7】
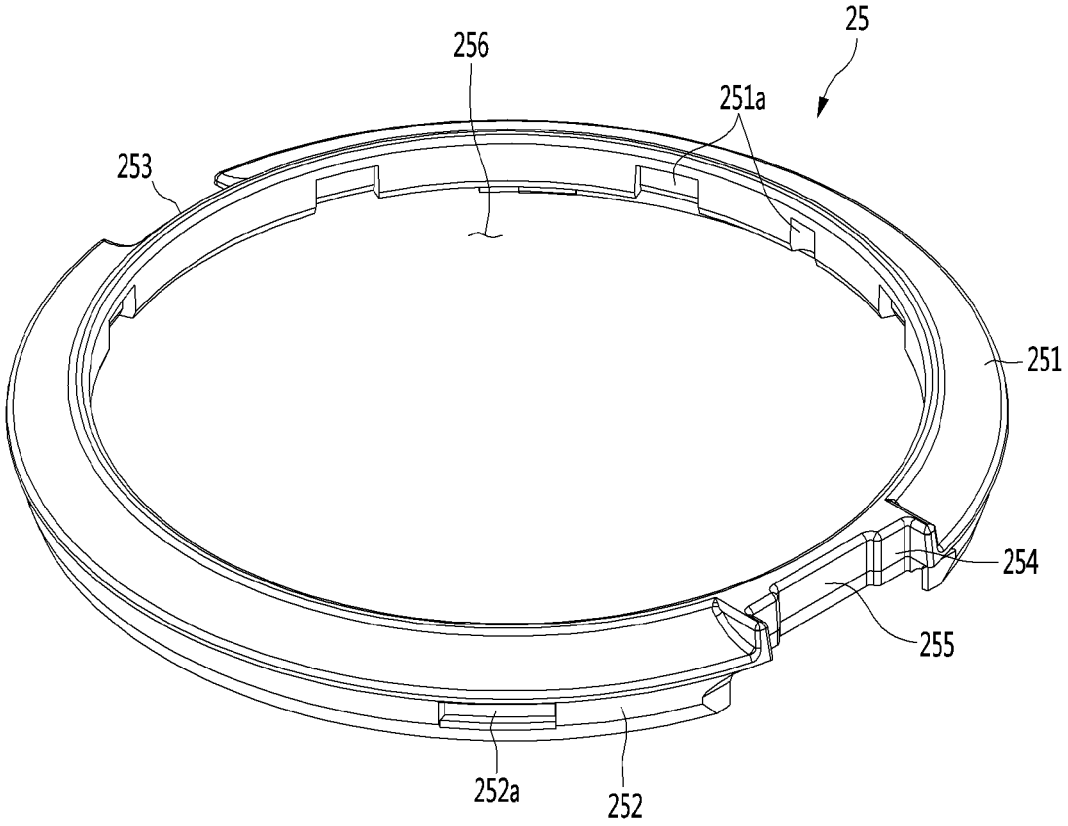

【Fig. 8】
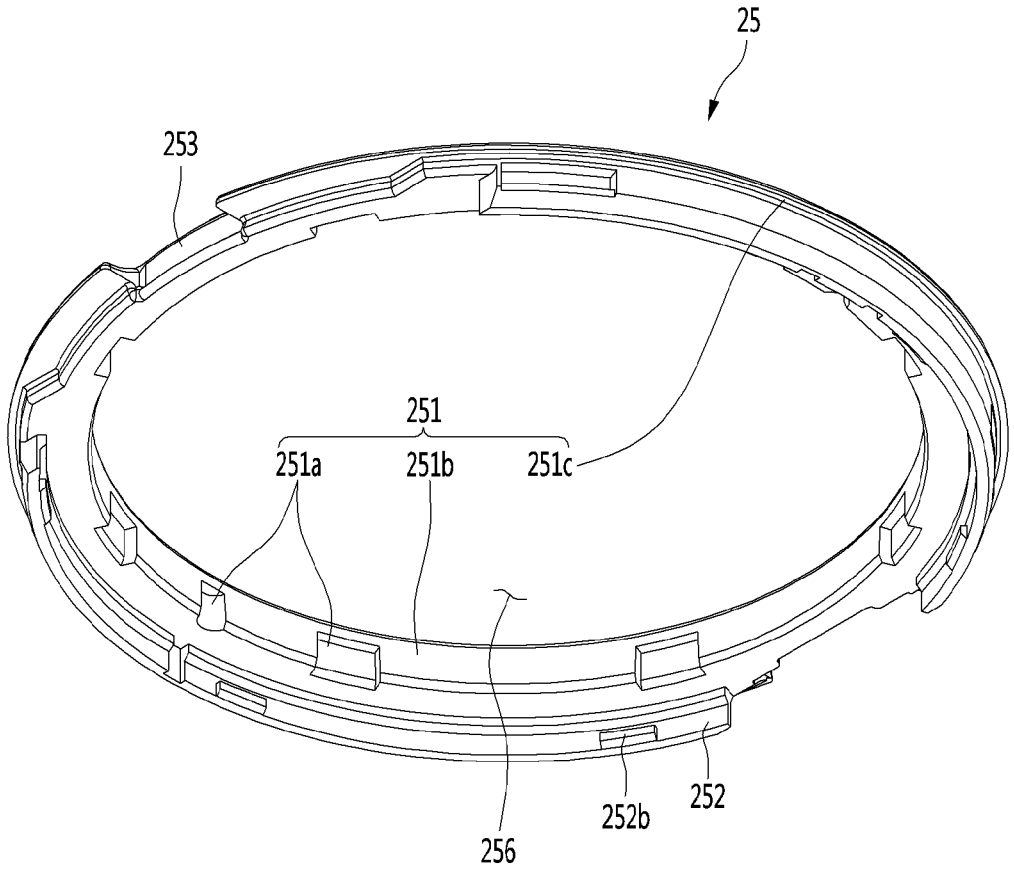

【Fig. 9】
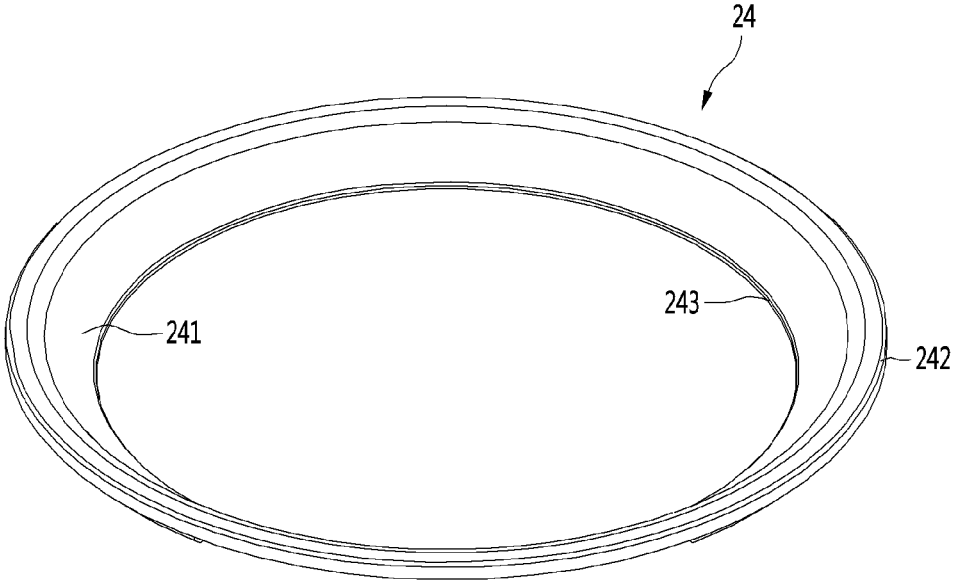
【Fig. 10】
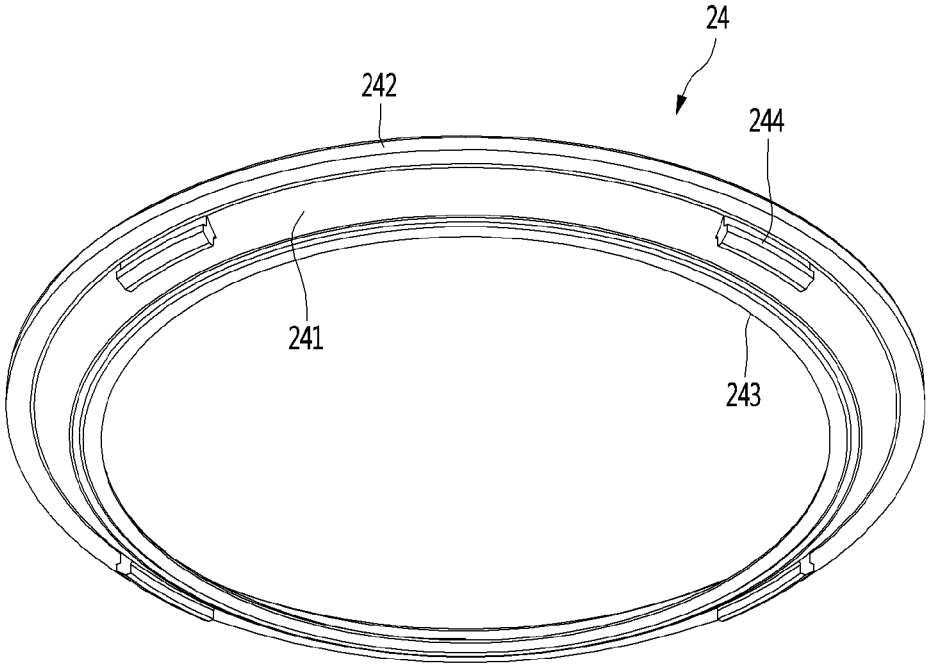

【Fig. 11】
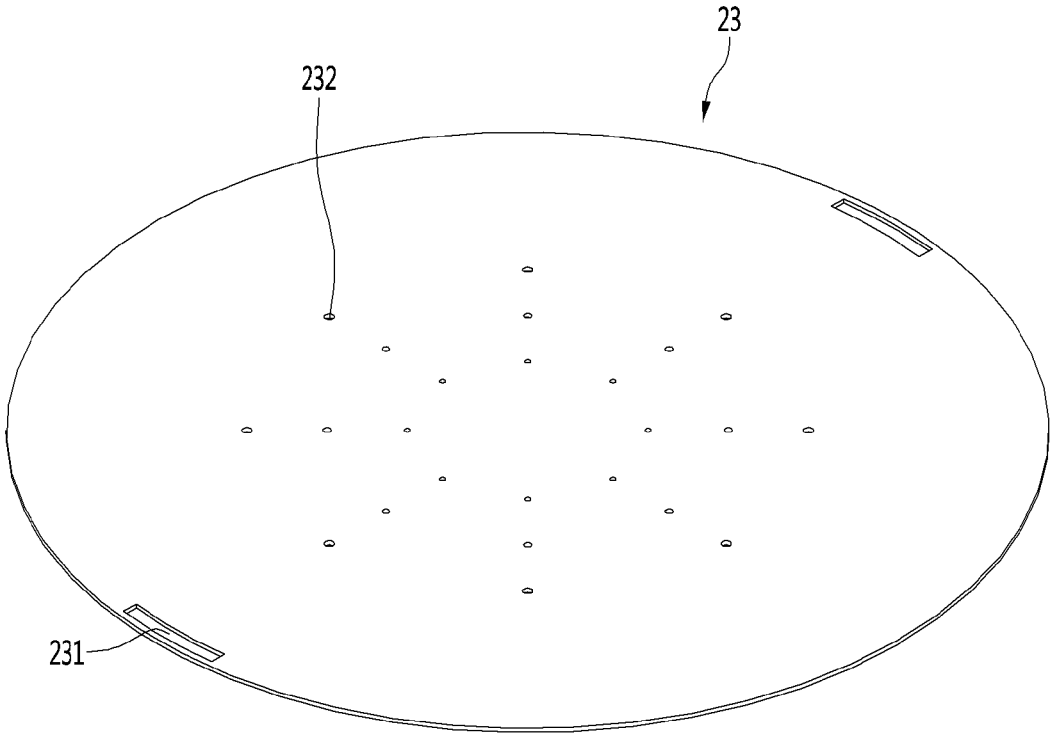

【Fig. 12】
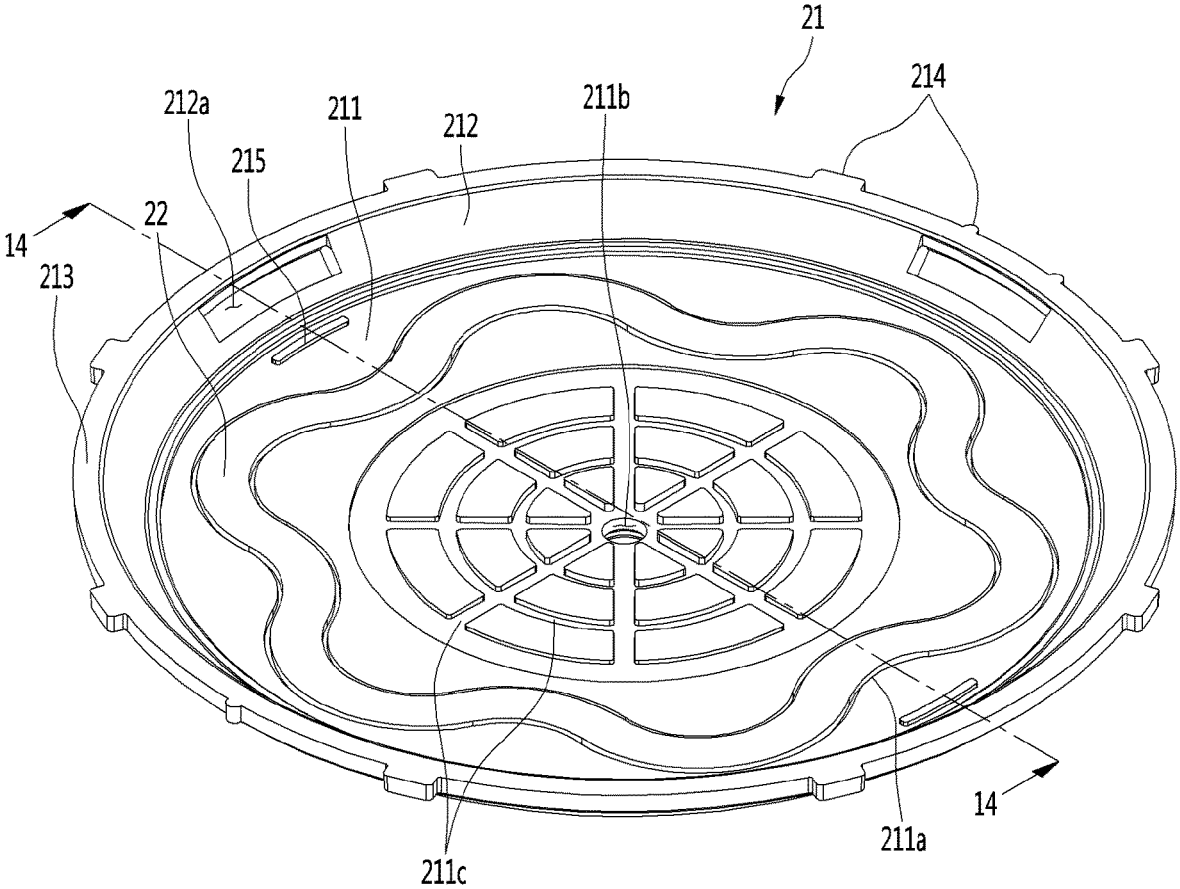

【Fig. 13】
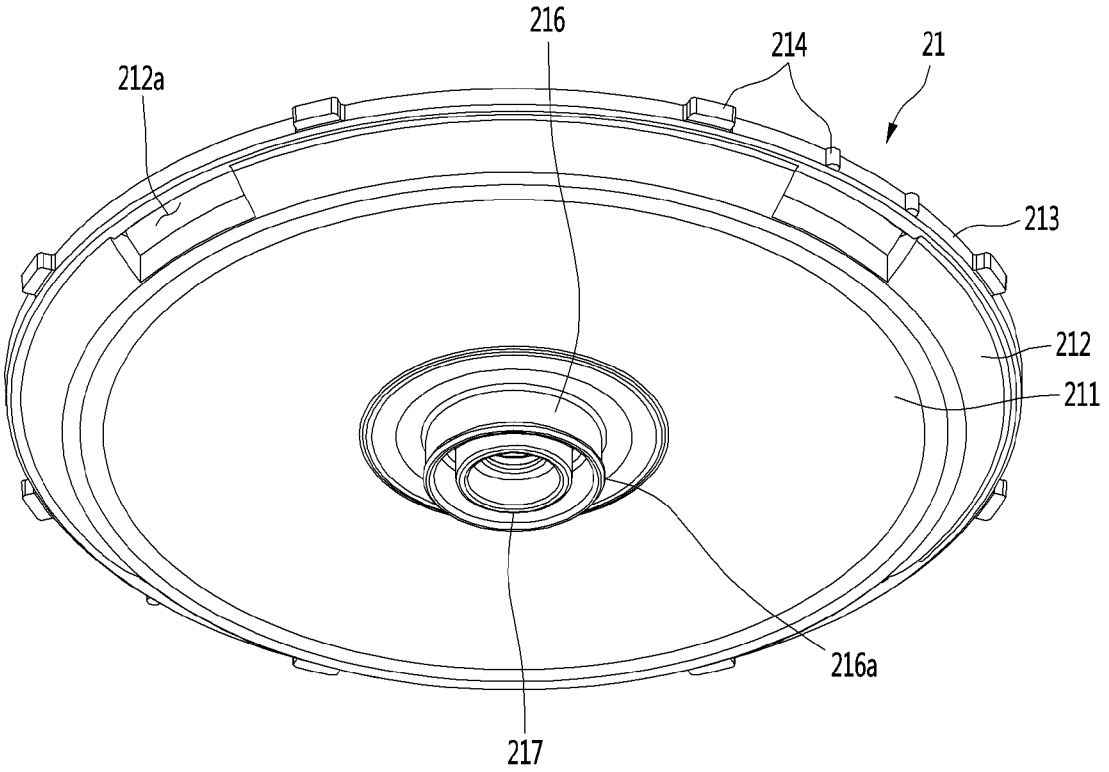

【Fig. 14】
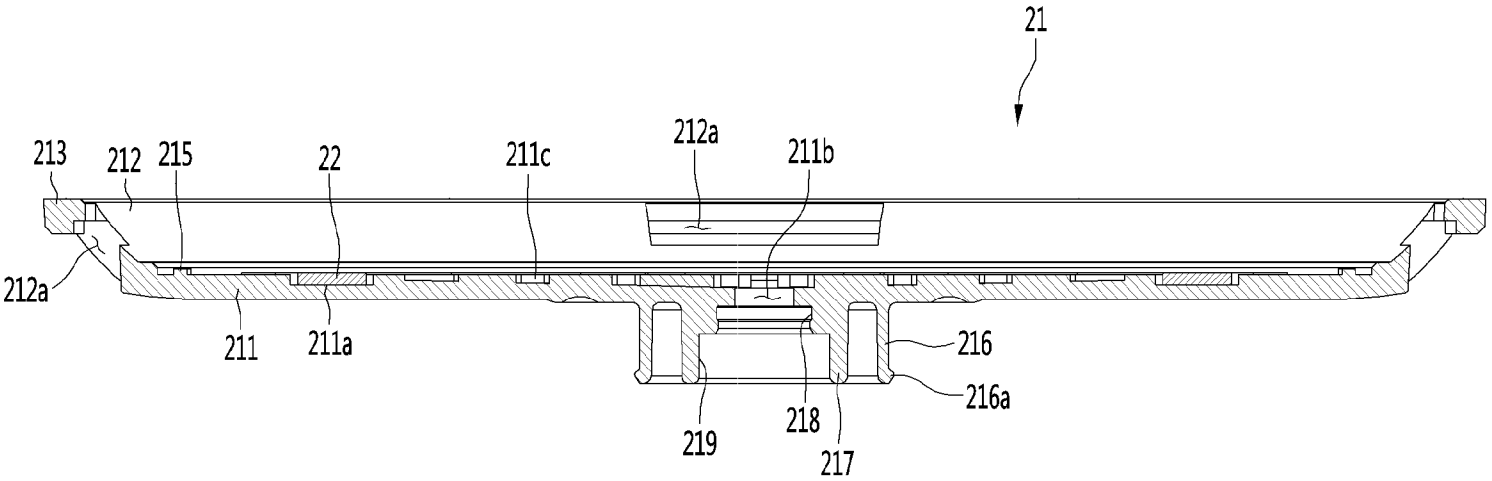

【Fig. 15】
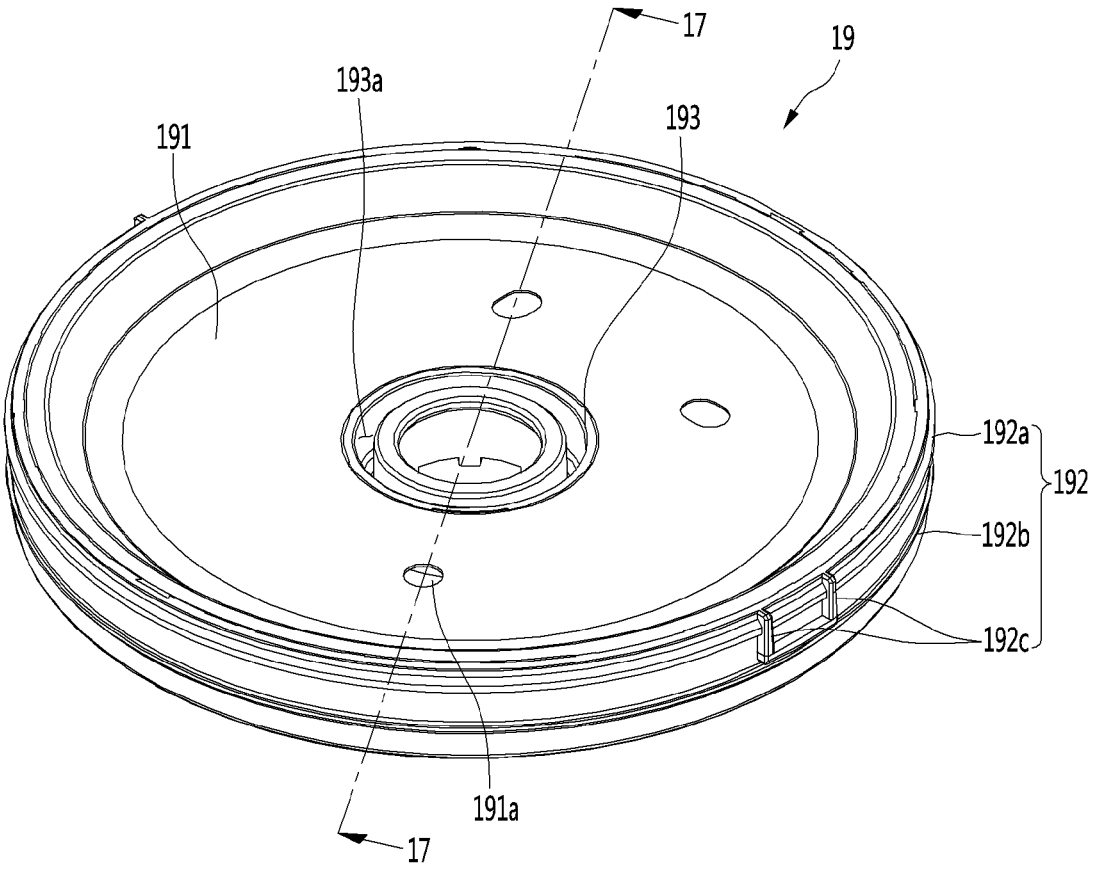

【Fig. 16】
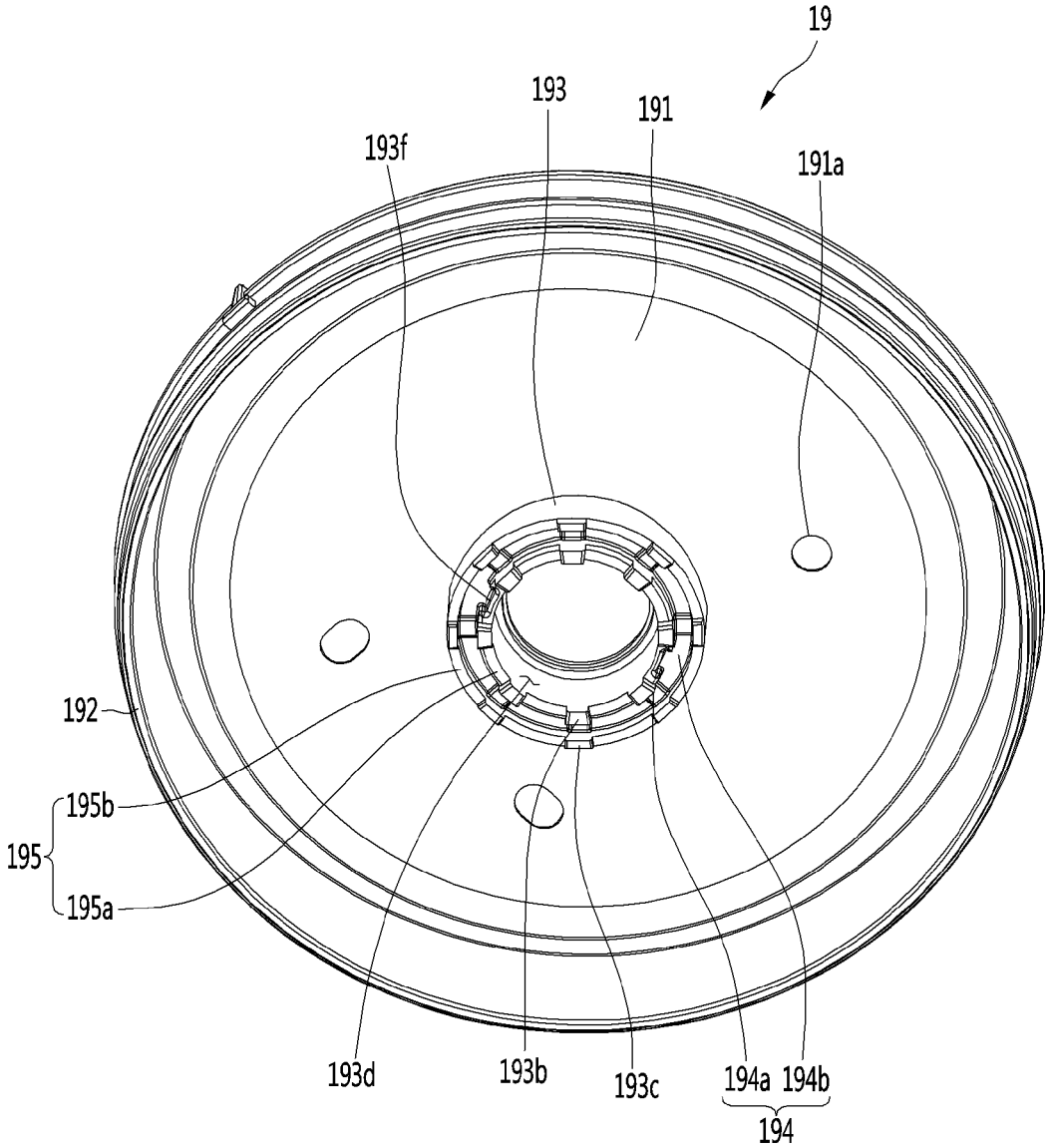

【Fig. 17】
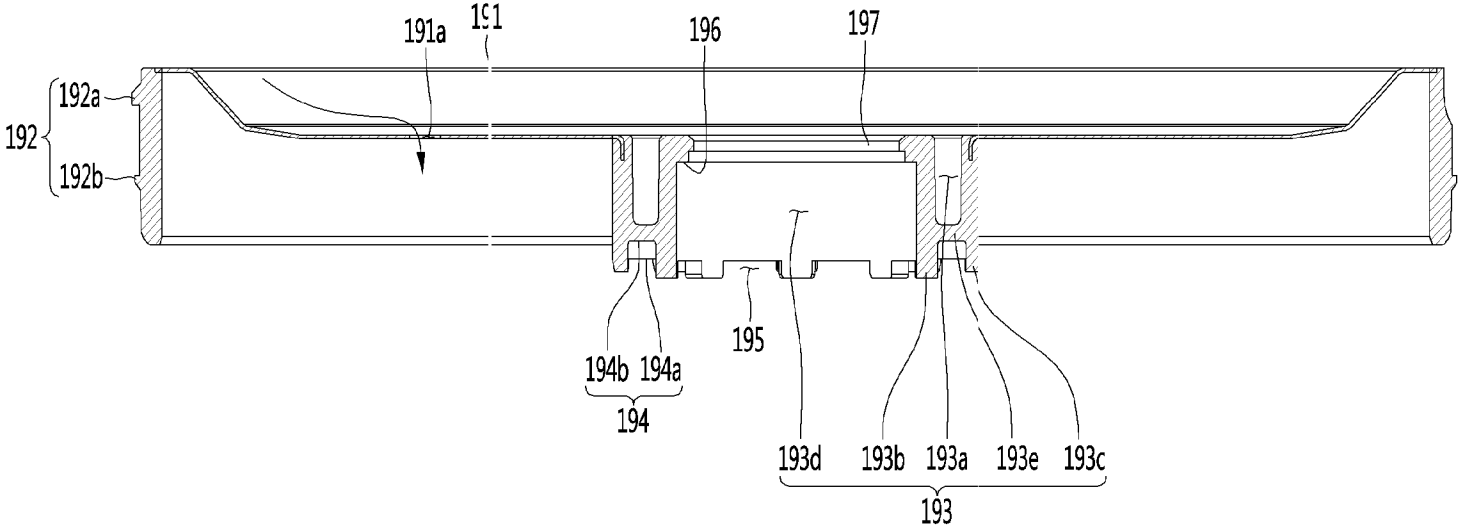

【Fig. 18】
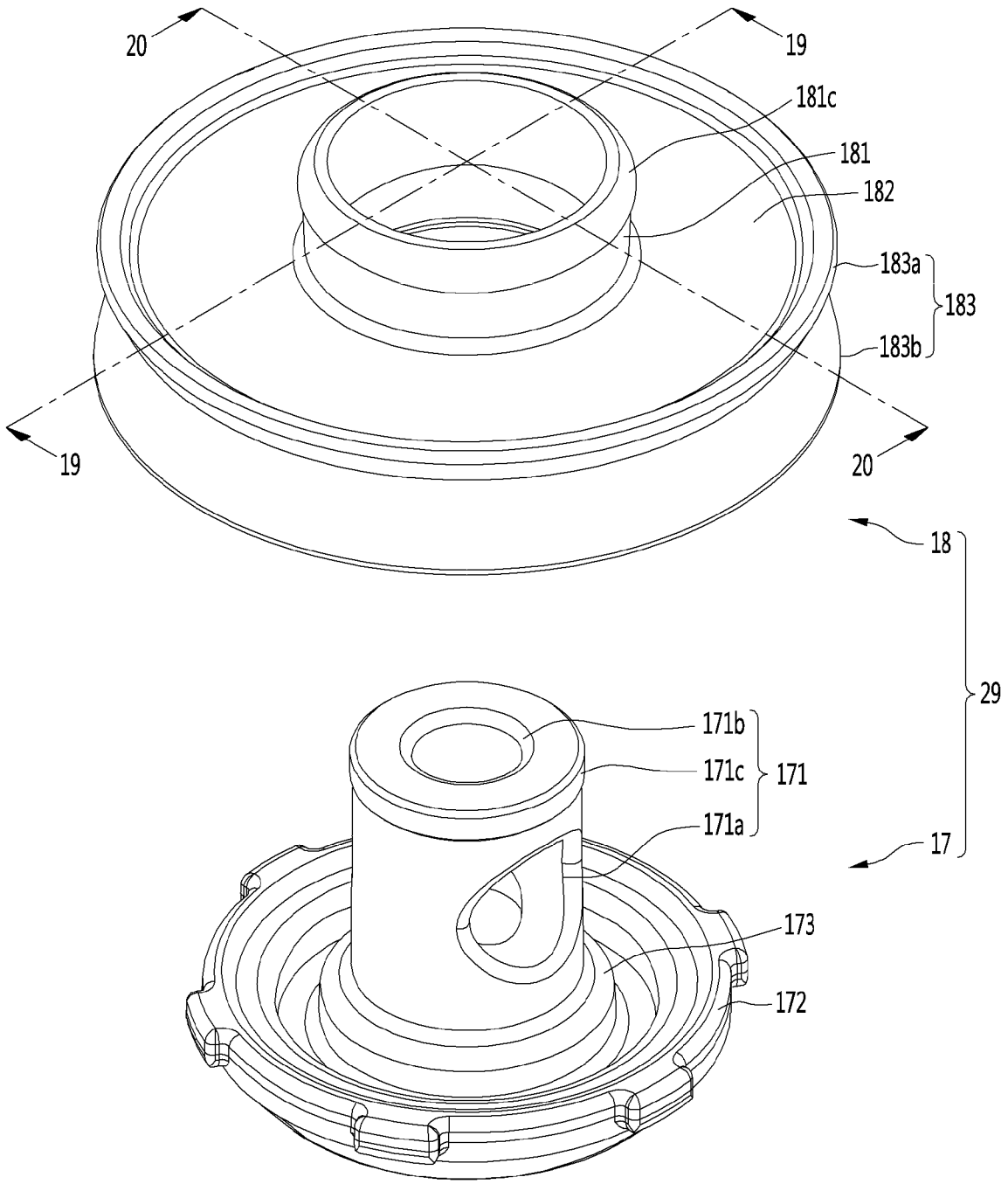

【Fig. 19】
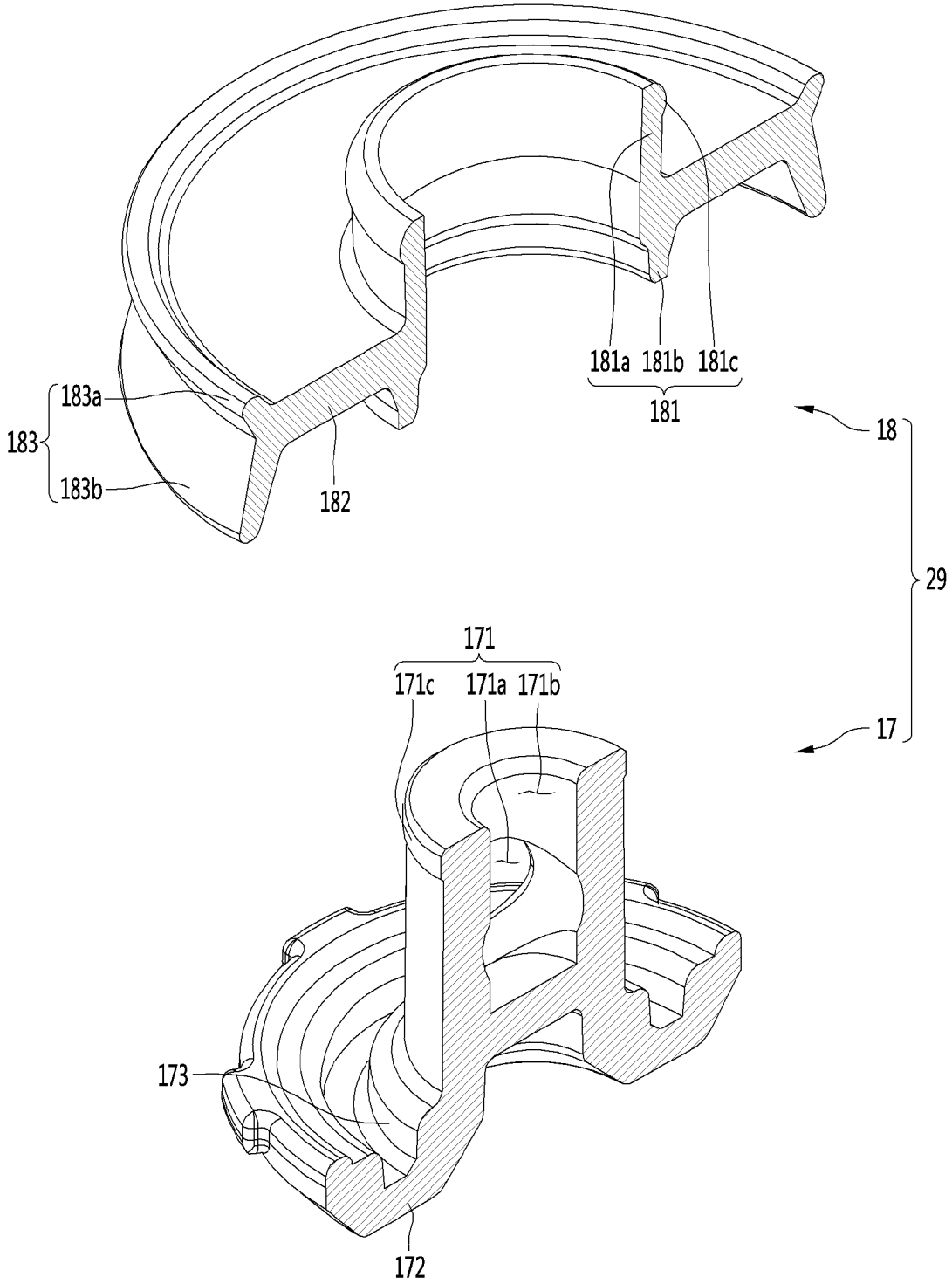

【Fig. 20】
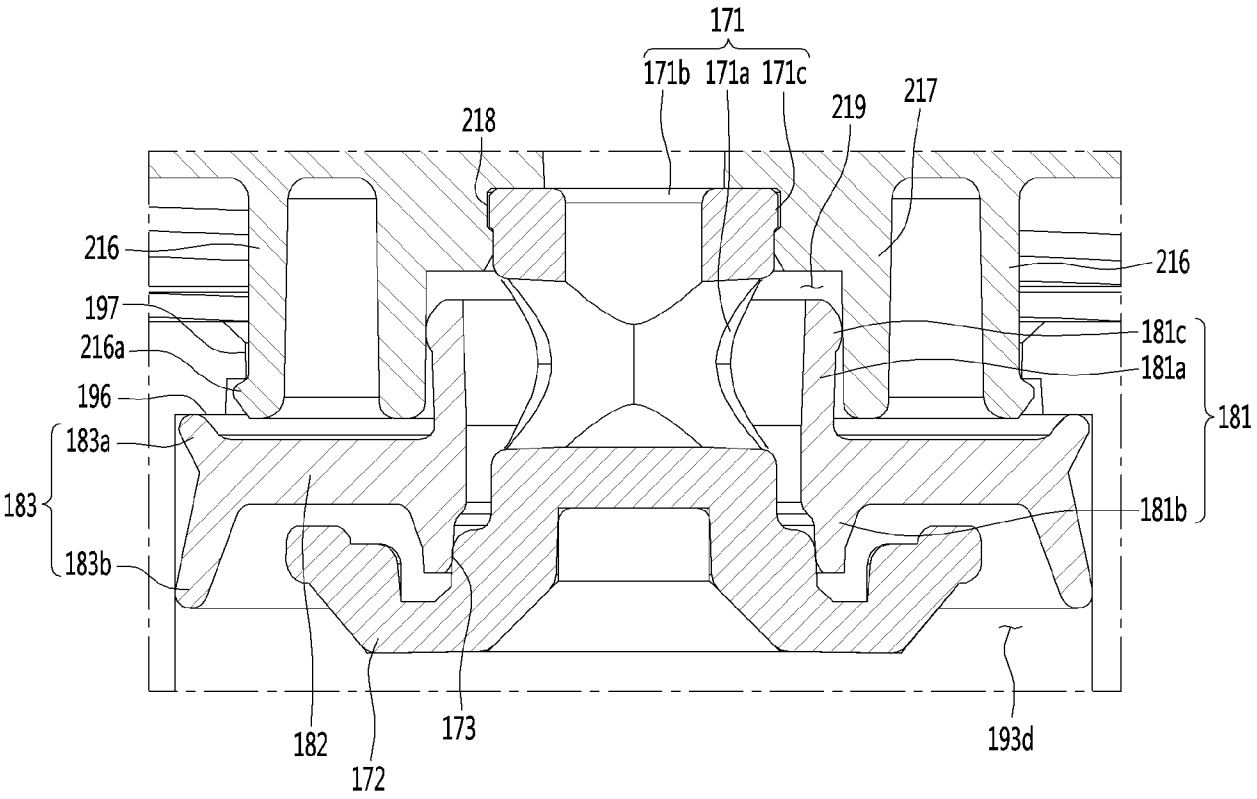

【Fig. 21】
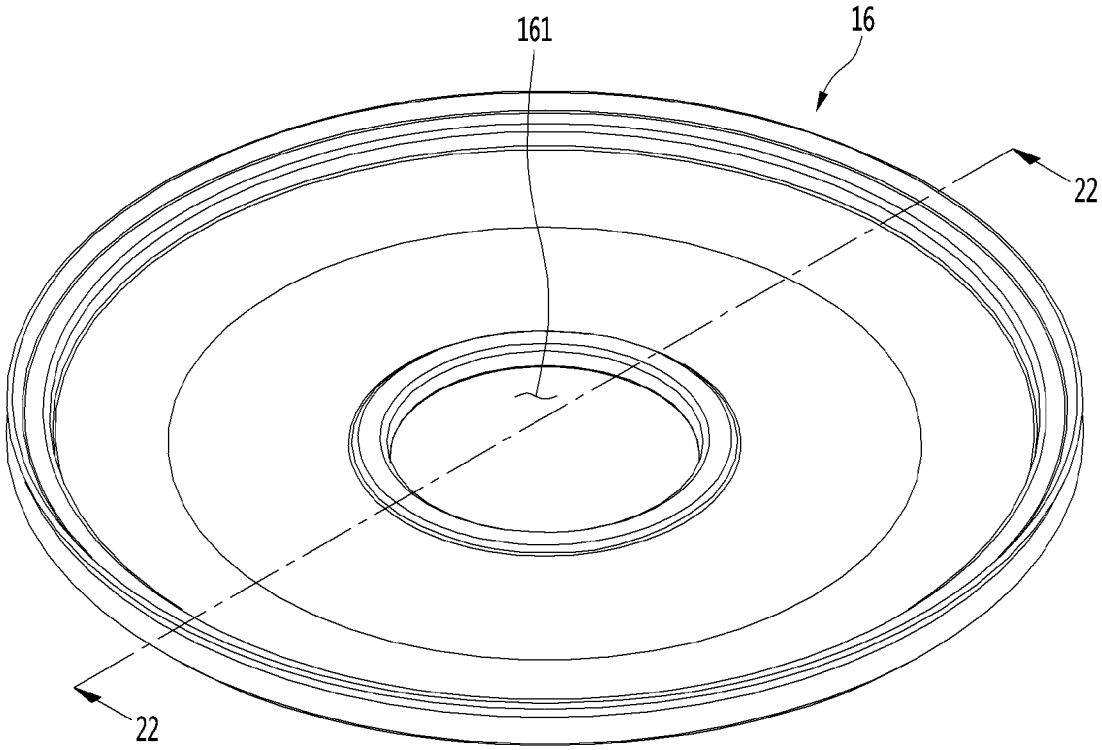
【Fig. 22】
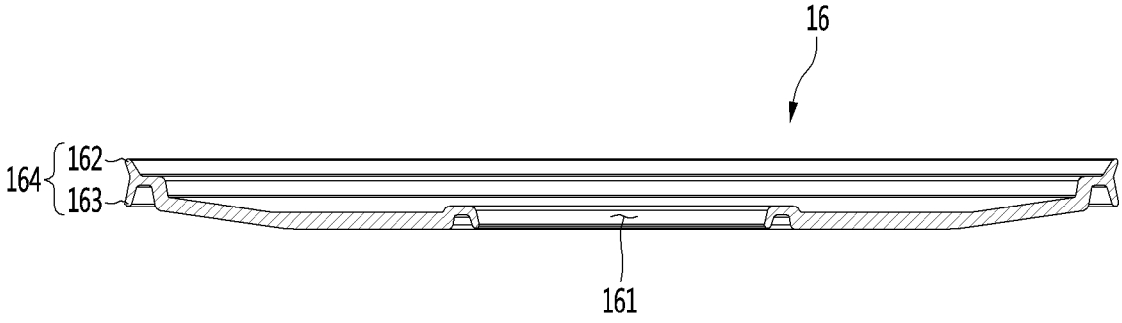

【Fig. 23】
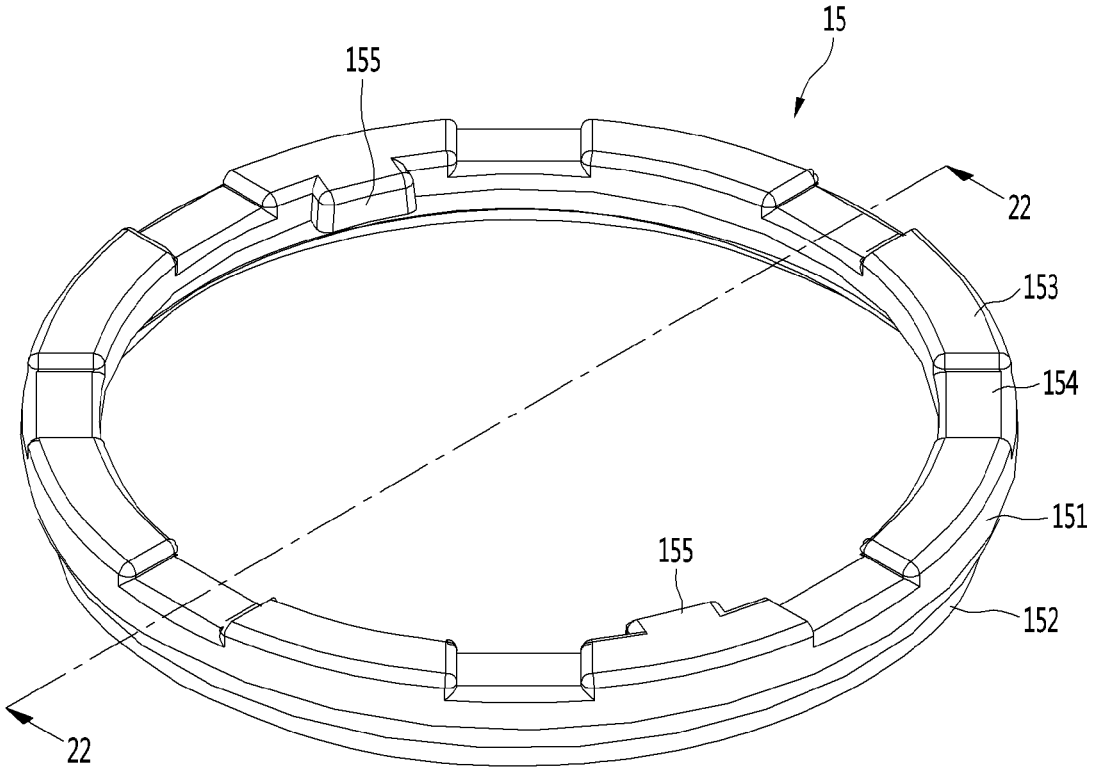

【Fig. 24】
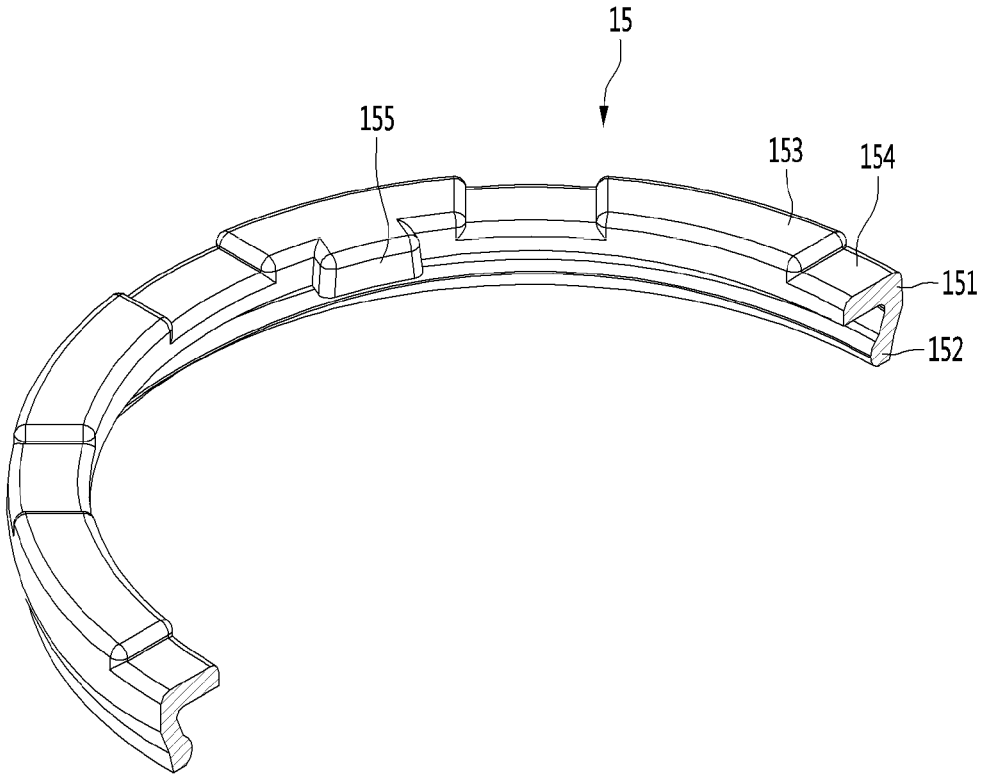

【Fig. 25】
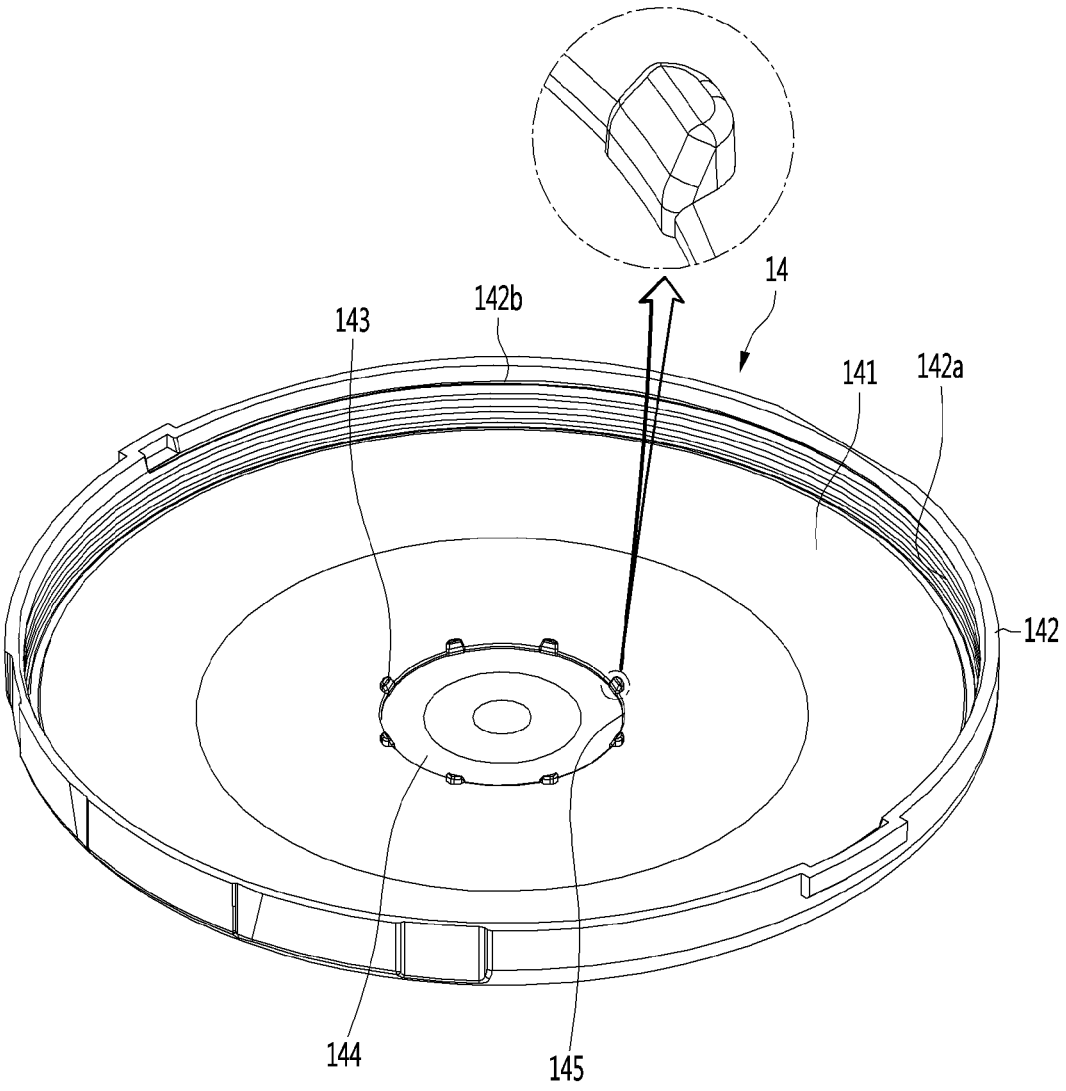

【Fig. 26】
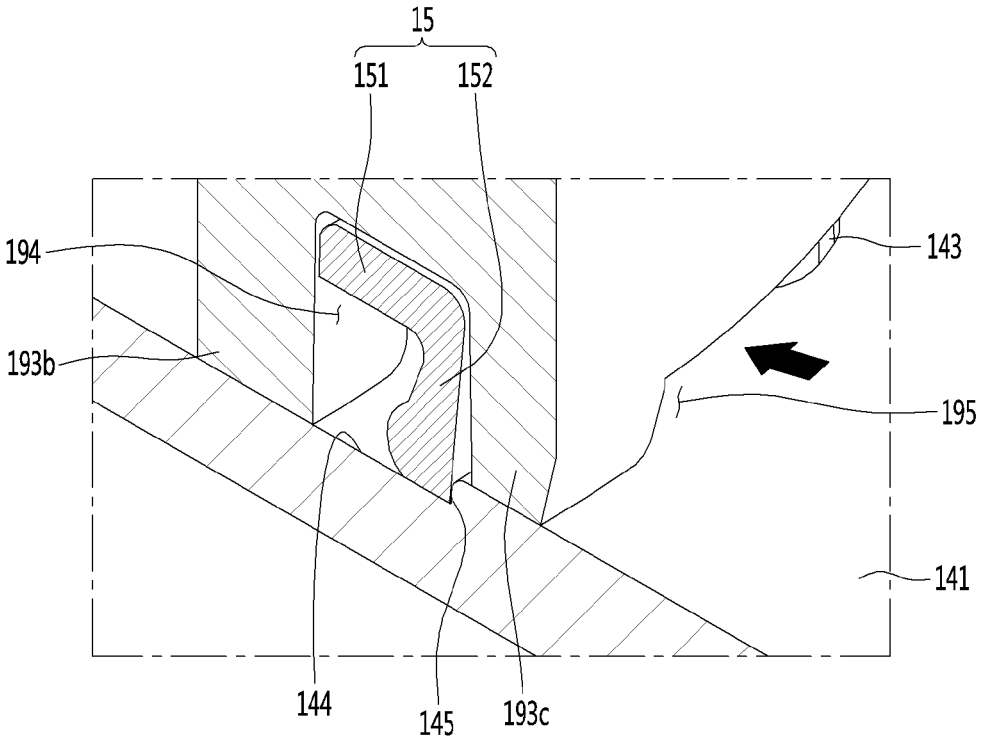

【Fig. 27】
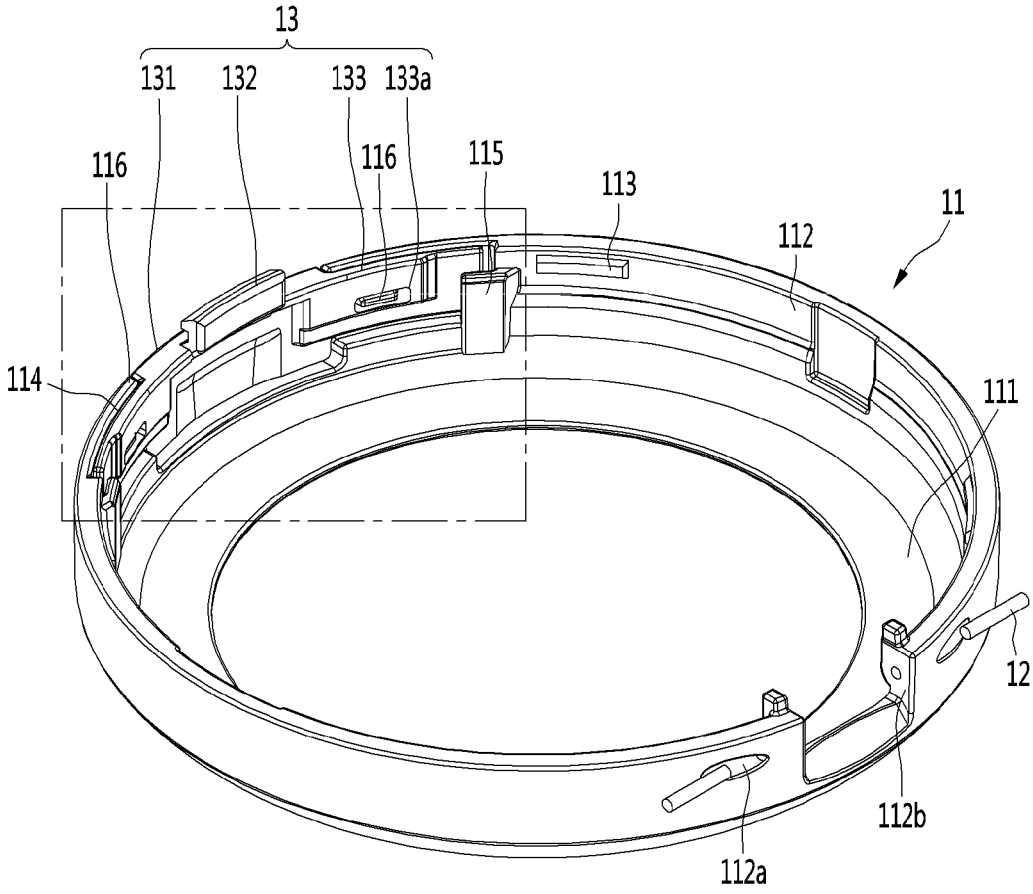

【Fig. 28】
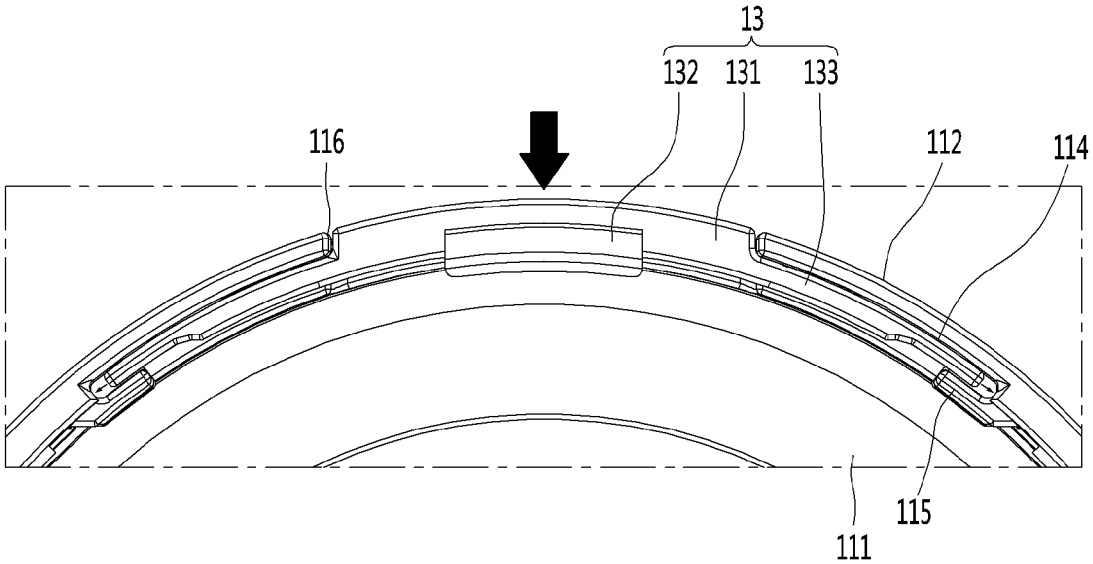

【Fig. 29】
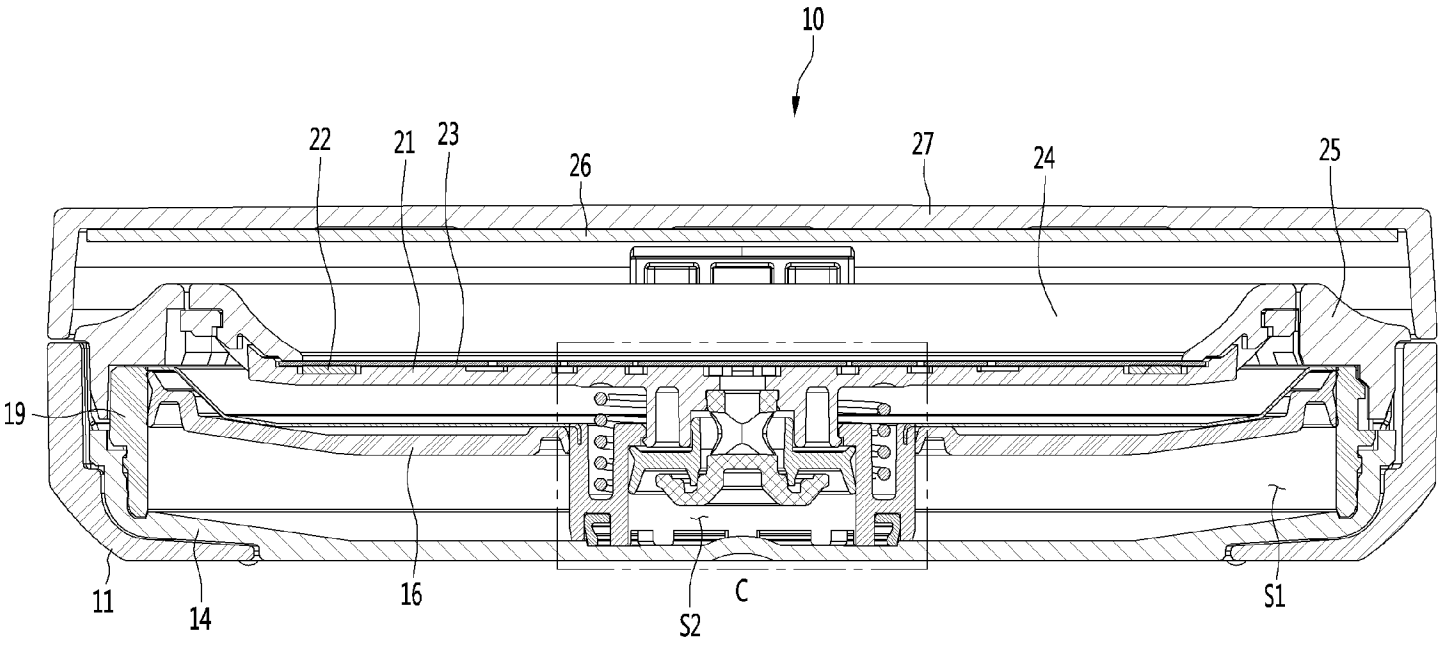

【Fig. 30】
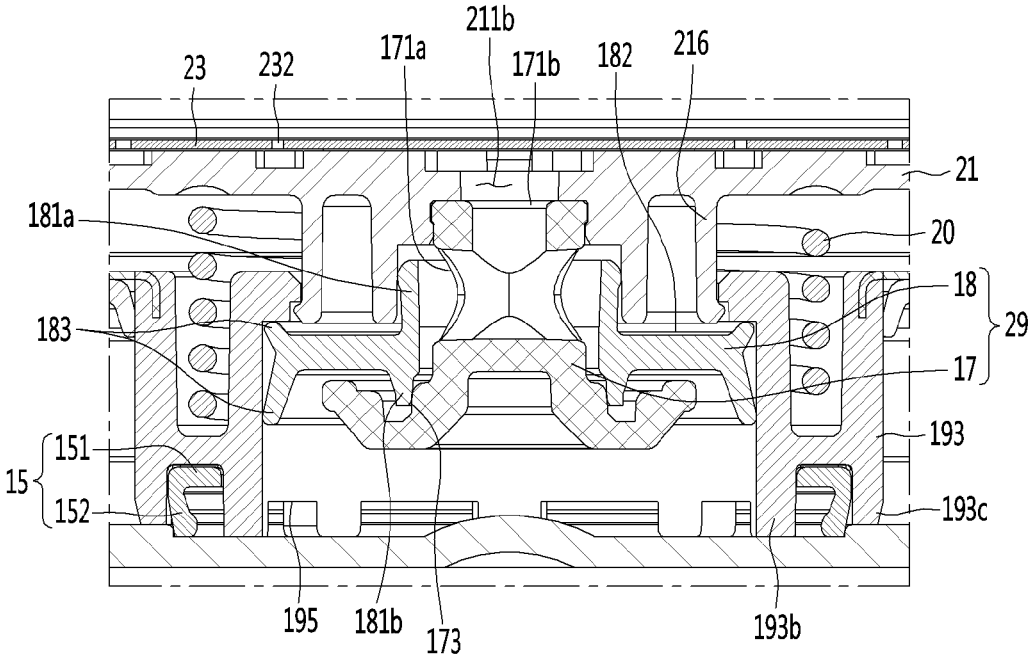

【Fig. 31】
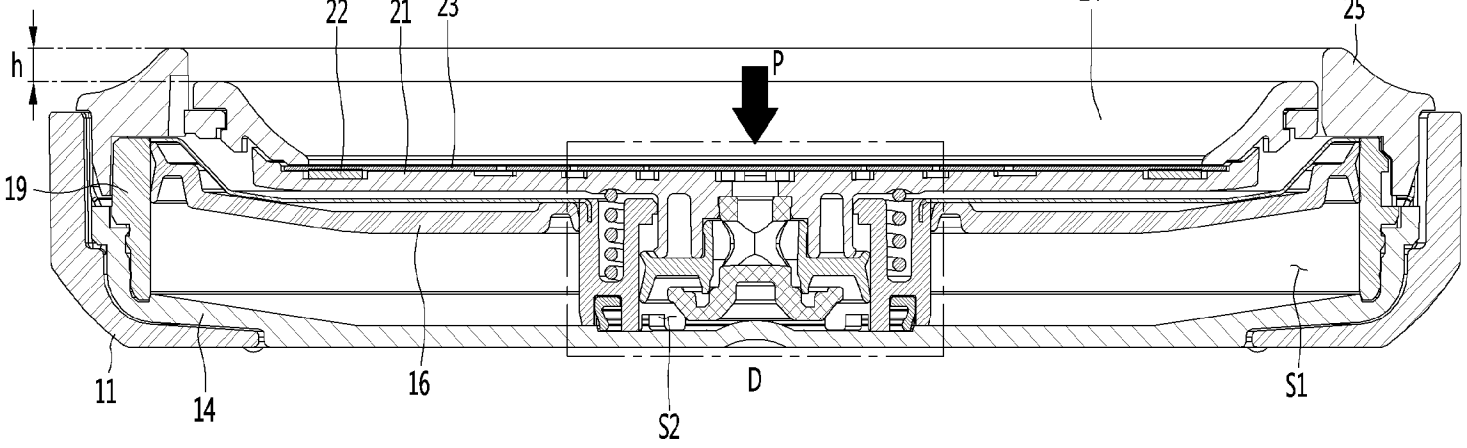

【Fig. 32】
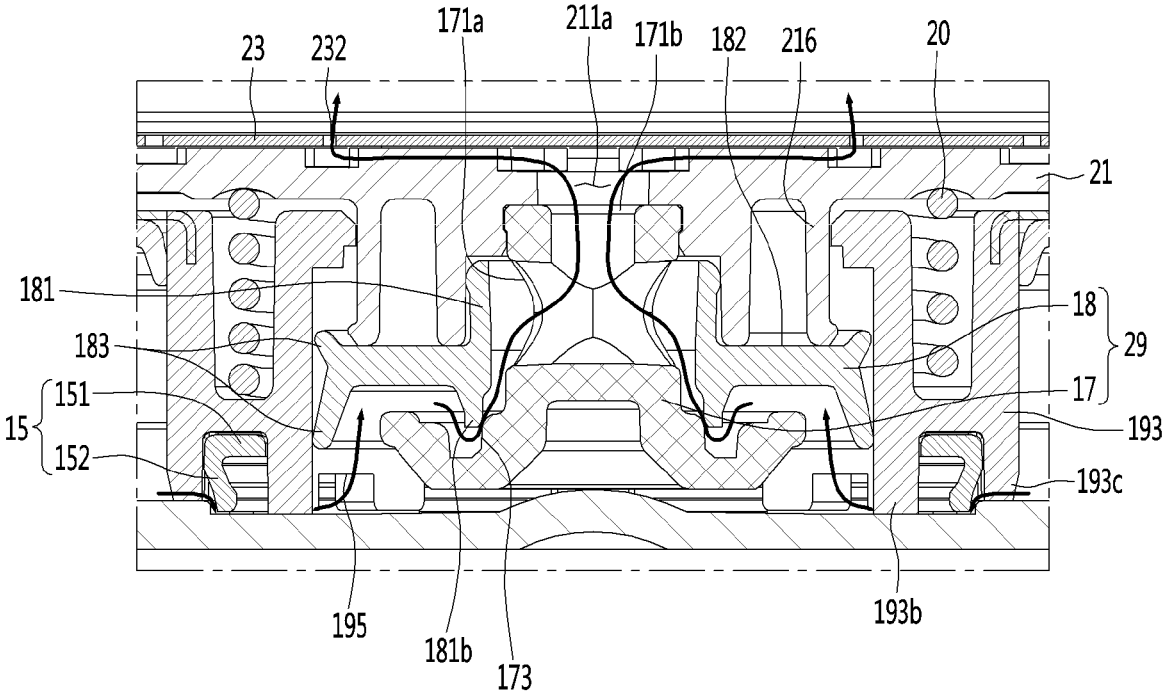

【Fig. 33】
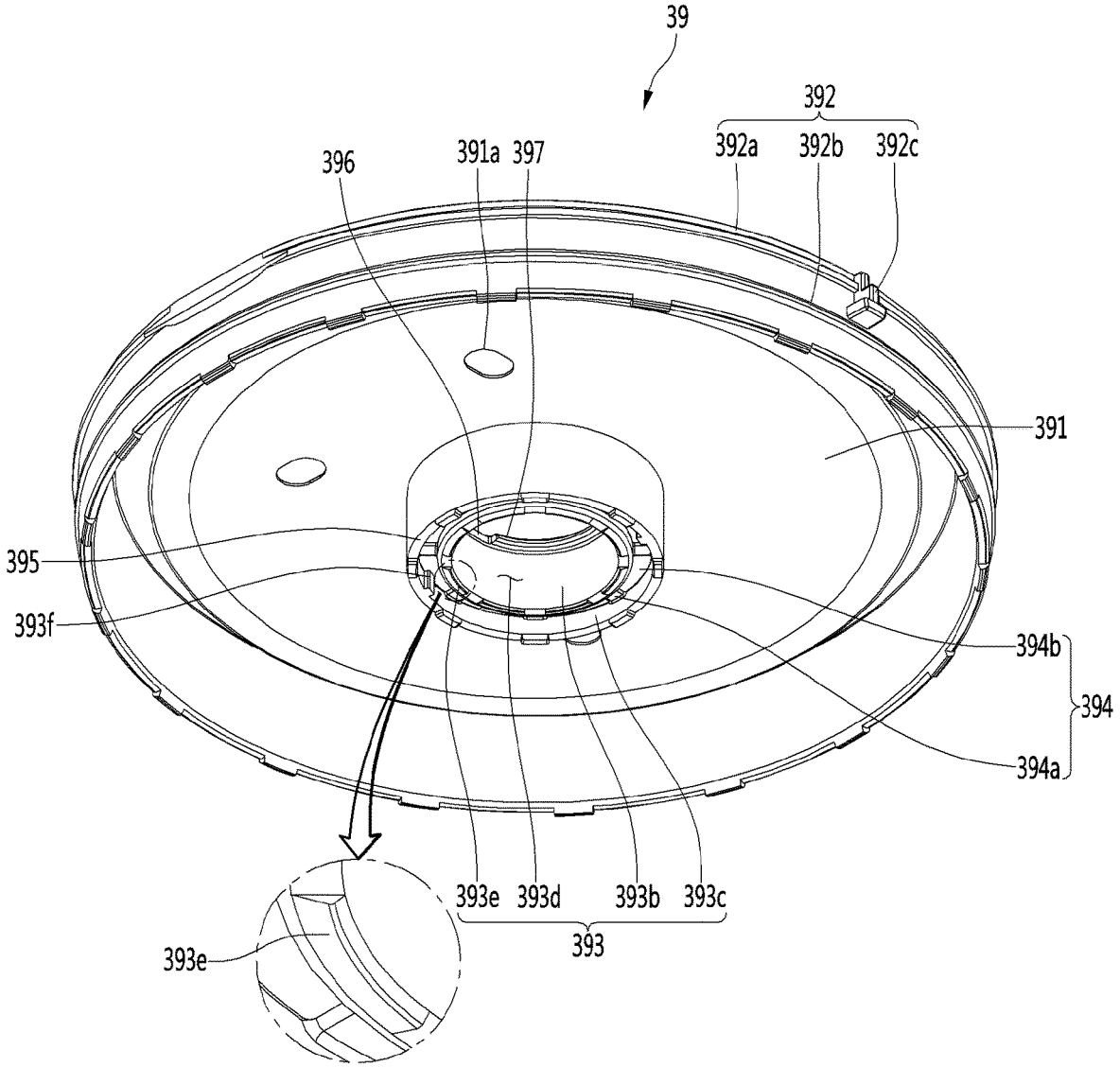

【Fig. 34】
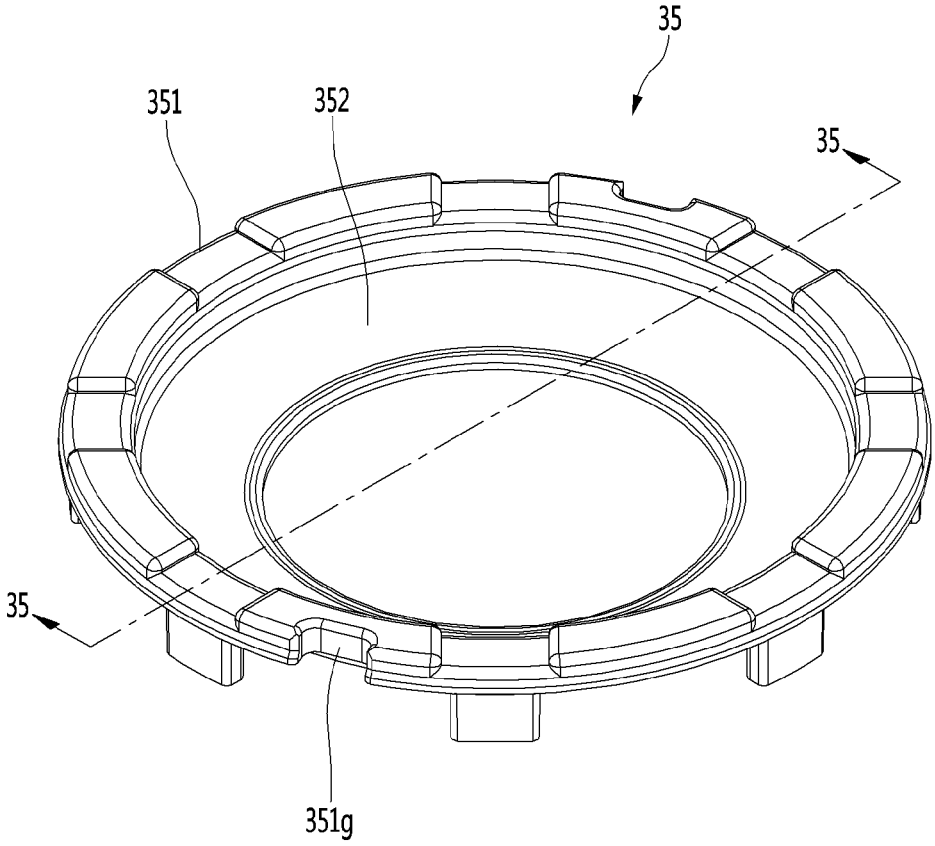

【Fig. 35】
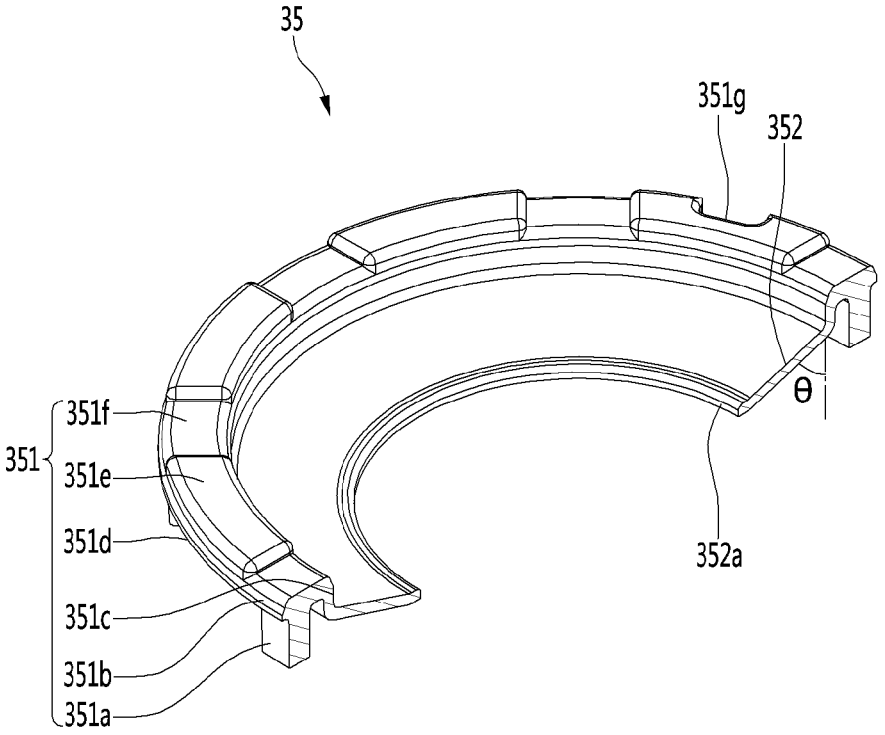

[Fig. 36]
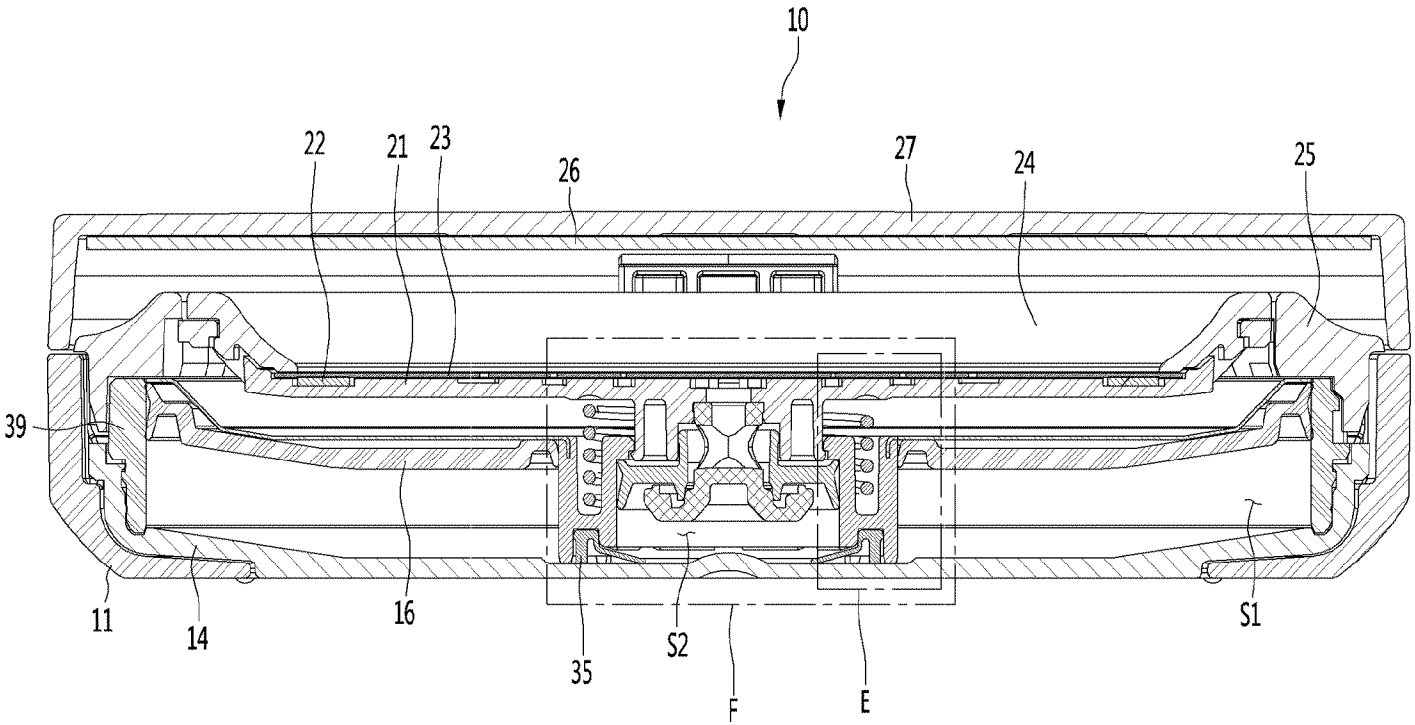

【Fig. 37】
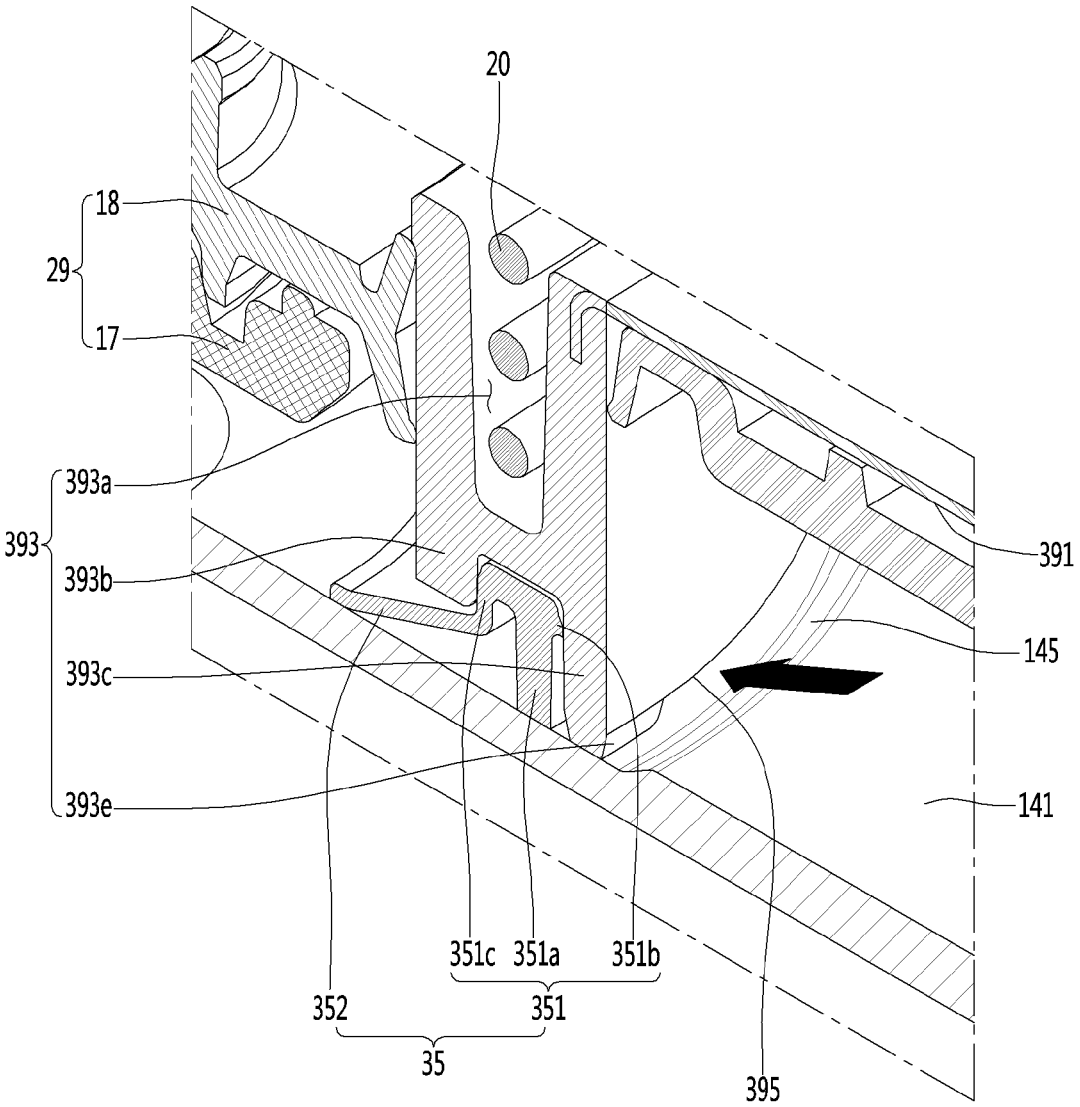

【Fig. 38】
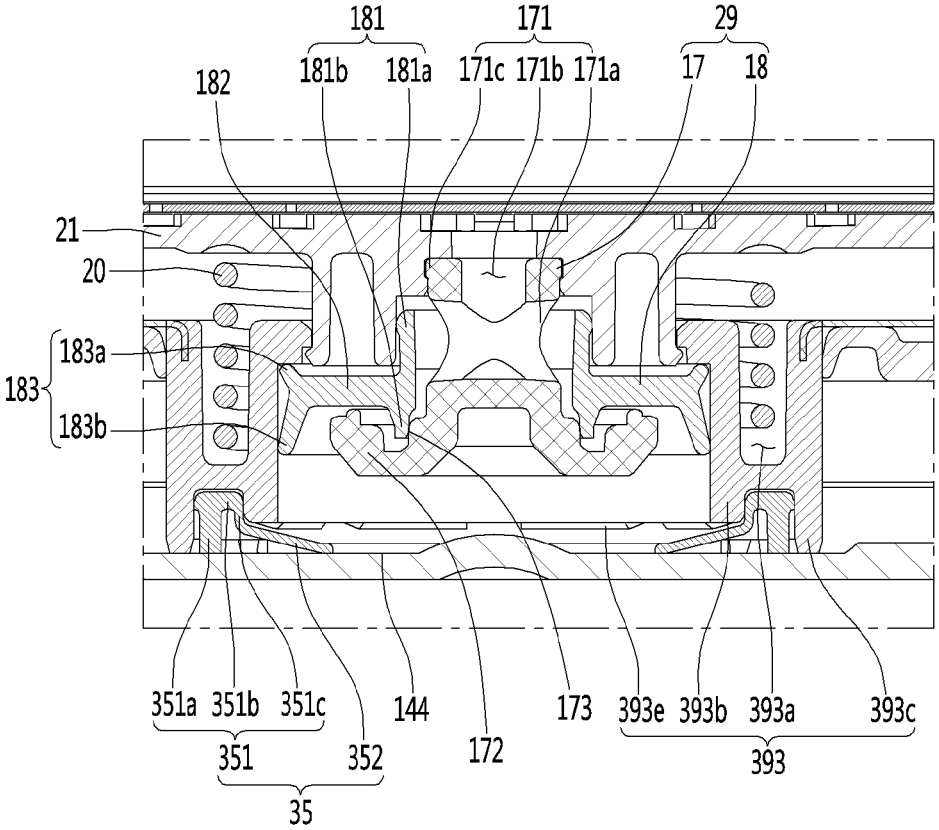

【Fig. 39】
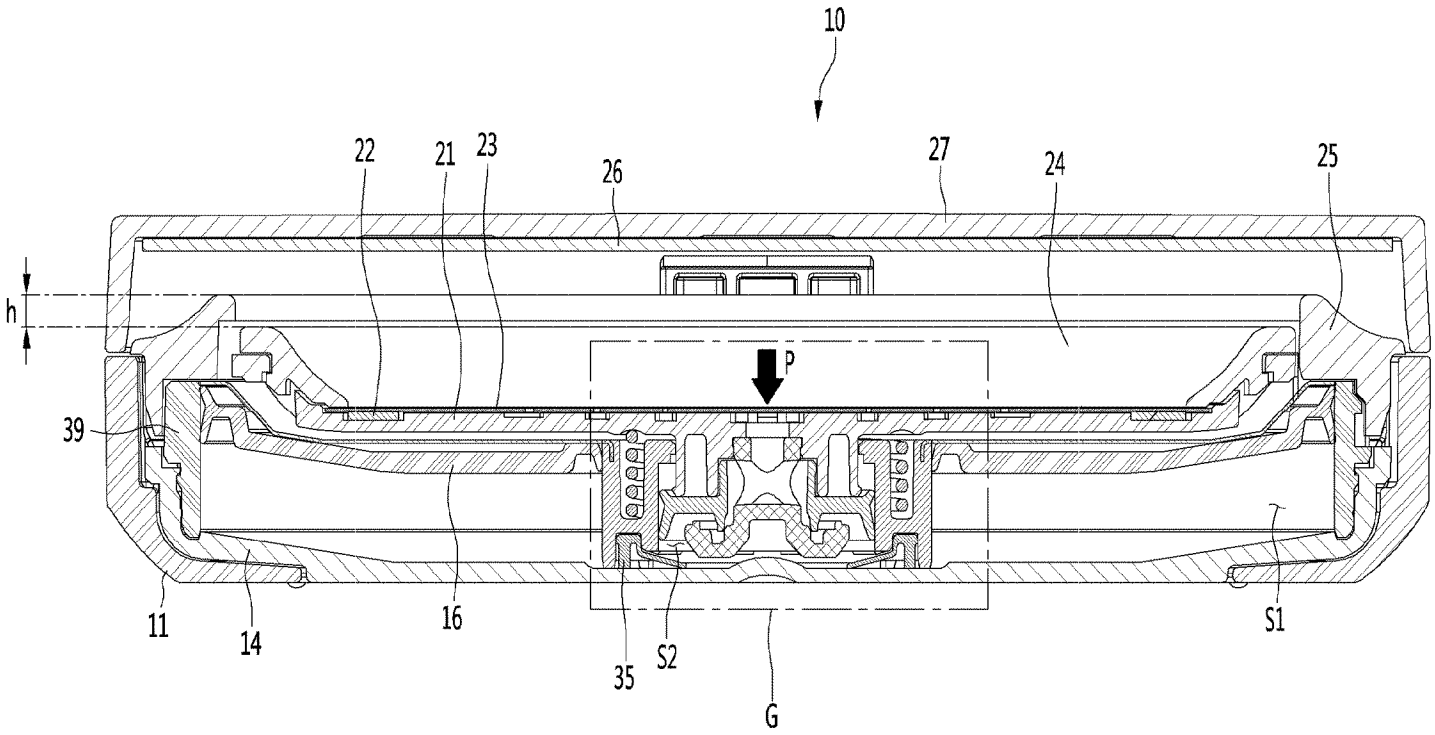

【Fig. 40】
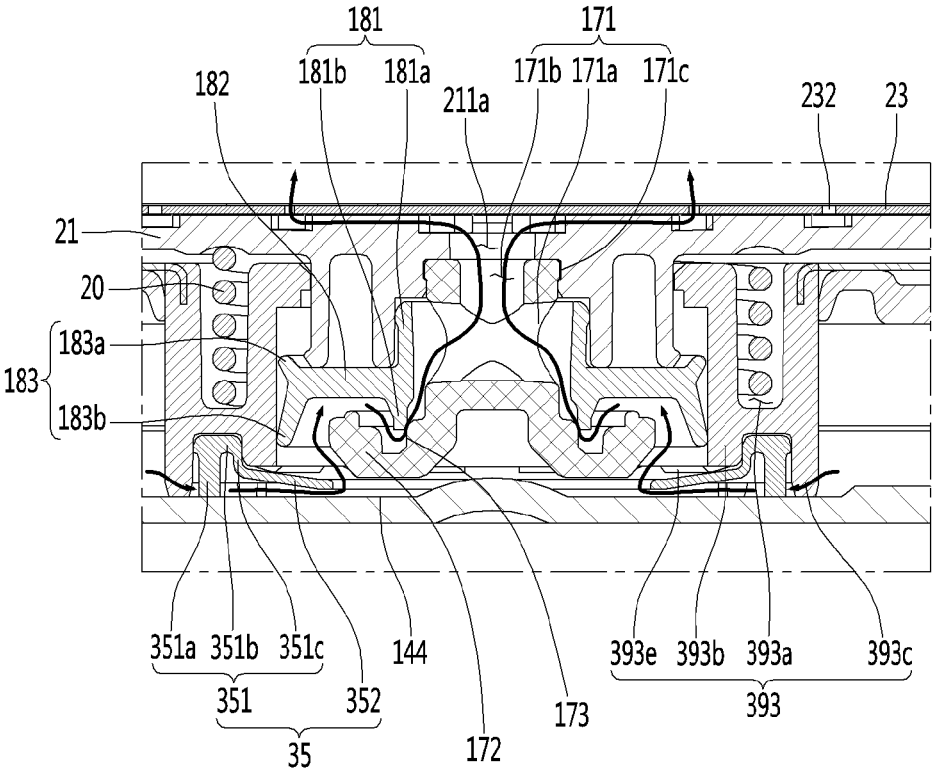

【Fig. 41】
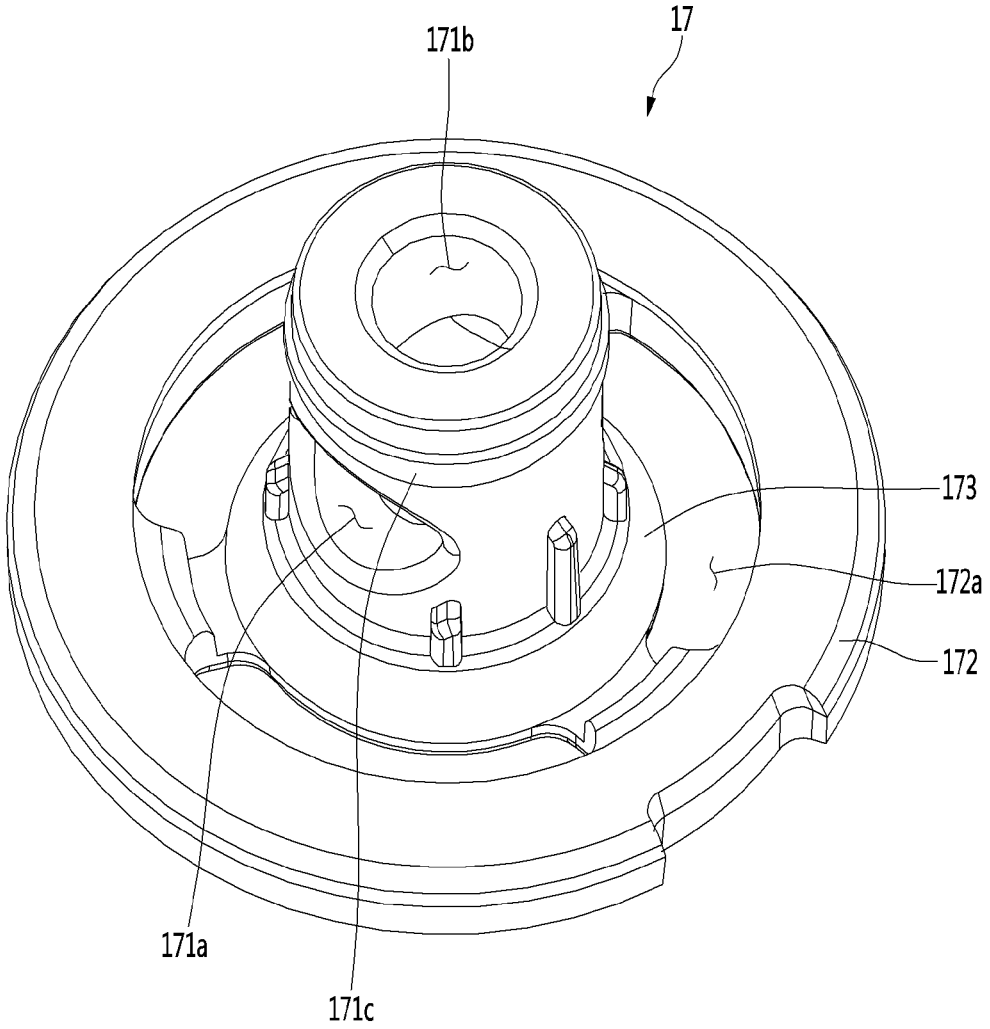

【Fig. 42】
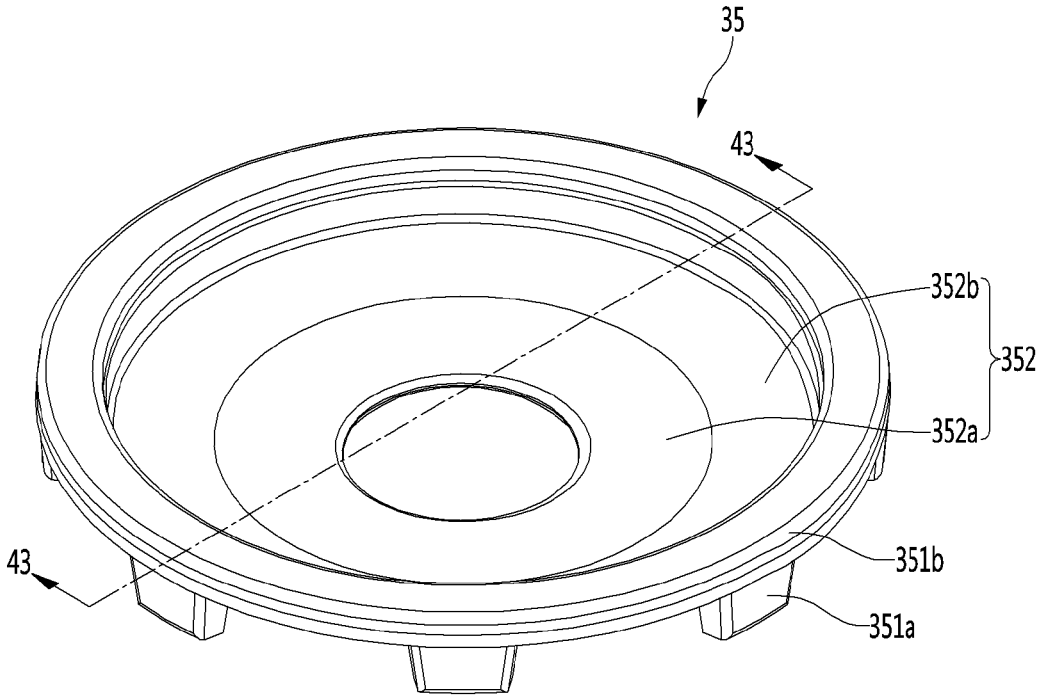

【Fig. 43】
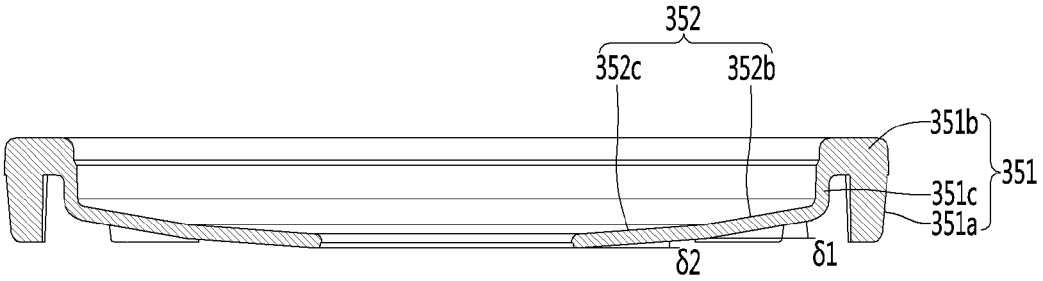
【Fig. 44】
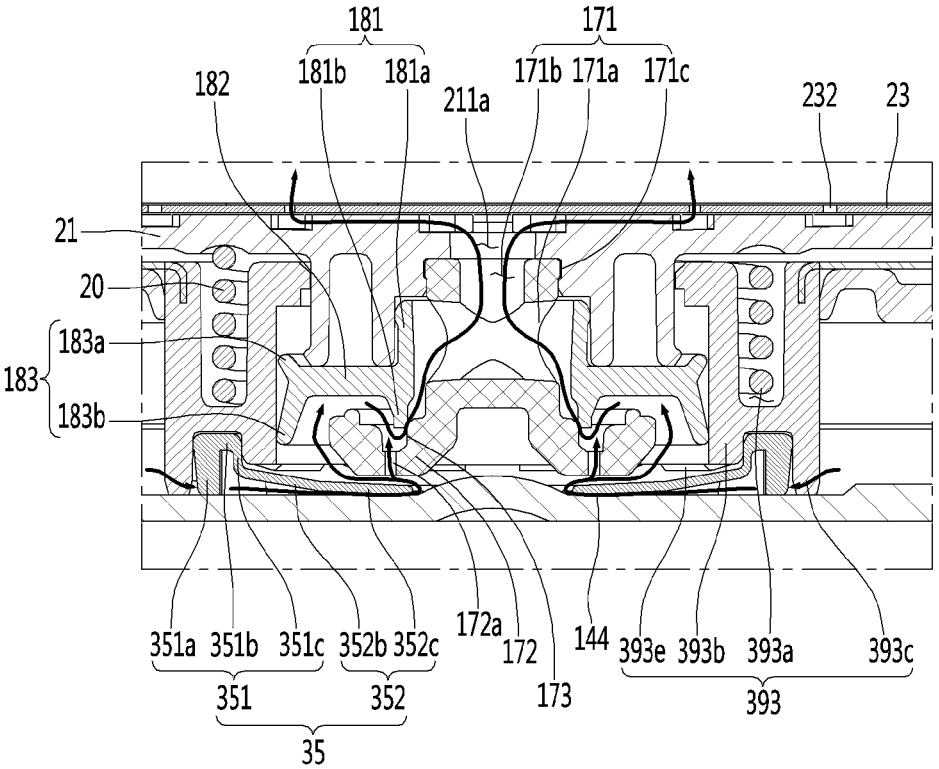

COSMETIC CONTAINER

CROSS REFERENCE TO RELATED APPLICATIONS

This application is a Divisional of copending application Ser. No. 16/623,689, filed on Dec. 17, 2019, which is the National Phase of PCT/KR2018/009135 filed on Aug. 9, 2018, which claims priority under 35 U.S.C. § 119(a) to Patent Application No. 10-2017-0102537 filed in the Republic of Korea on Aug. 11, 2017, all of which are hereby expressly incorporated by reference into the present application.

FIELD OF THE INVENTION

The present invention relates to a cosmetic container.

BACKGROUND OF THE DISCLOSURE

As a kind of cosmetics, a compact in which powdered cosmetics are applied to a face of a woman using a puff is widely known.

Conventionally, since powdered cosmetics were applied to a face, there was a problem that the powder was scattered in the air and could not be firmly adhered to the face. In recent years, in order to improve such a problem, there has been released a compact which allows a liquid or gel cosmetic to permeate into a puff and the liquid or gel cosmetic to permeate into a facial skin by tapping the puff on the face.

A compact container in which a liquid or gel cosmetic is stored has been proposed in the prior art described below.

However, the related art presented still has following problems.

In detail, in order to discharge a cosmetic solution, a lifting member should be pressed downward by a predetermined length, and the length to be pressed may be defined as a stroke. When the lifting member is moved down, a piston is moved down together, and a flange of the piston is moved down with the same stroke.

In addition, a check valve and a support structure for accommodating the check valve are provided directly below the flange. And the check valve and check valve support structure should not be interfered at least when the flange of the piston is fully moved down.

In order to satisfy such a condition, a thickness of the cosmetic container should be secured to some extent, and there is a disadvantage that the check valve and the check valve support structure positioned directly below the flange of the piston become an obstacle that prevents the thickness of the cosmetic container from being further reduced.

SUMMARY OF THE INVENTION

The present invention has been proposed in order to improve the problems of the related art as described above.

A cosmetic container according to an embodiment of the present invention for achieving the object as described above includes: a base member; a housing including a support sleeve placed on an upper surface of the base member, a center sleeve placed on the upper surface of the base member at an inner center of the support sleeve, a partition plate connecting an upper end of the support sleeve and an upper end of the center sleeve, a main storage space formed between the support sleeve and the center sleeve, and a temporary storage space formed inside the center sleeve; a frame coupled to an upper end of the housing and having a hole of a predetermined size formed therein; a stem coupled to the frame so as to be movable in a vertical direction while being accommodated in the hole and having a discharge port for discharging a cosmetic solution formed in a center thereof; a piston assembly mounted on a bottom surface of the stem and accommodated in the temporary storage space; and a disc valve mounted on a lower end of the center sleeve for selectively communicating the main storage space and the temporary storage space, wherein the disc valve is disposed outside a region in which the piston assembly is moved up and down.

According to a cosmetic container according to an embodiment of the present invention including the above-described configuration, a disc valve structure that allows a cosmetic solution to selectively flow into a temporary storage space from a main storage space of the cosmetic solution is disposed outside a moving up and down region of a piston assembly. As a result, a phenomenon that a lower end portion of the piston assembly and the disc valve are interfered with each other is eliminated, and thus there is an advantage that the cosmetic container may be made compact.

In addition, there is an advantage that an amount of the cosmetic solution to be ejected is maintained constant.

Further, a discharge path resistance of the cosmetic solution is remarkably reduced by forming a through-hole in a flange of a piston body, and thus there is an advantage that discharge of the cosmetic solution is maintained uniformly.

Further, a contact area between a flap portion of the disc valve and a bottom of an inner base is increased, and thus there is an advantage that an opening/closing function of the cosmetic solution, that is, a closing function of the valve is improved. Furthermore, the entire area of the flap portion increases, so that an area in which pressure which pushes up cosmetics acts increases, and thus there is an advantage that the cosmetic solution is discharged smoothly.

BRIEF DESCRIPTION OF THE DRAWINGS

FIG. 1 is a perspective view in a state in which a cover of a cosmetic container according to an embodiment of the present invention is closed.

FIG. 2 is a perspective view in a state in which the cover of the cosmetic container is opened.

FIG. 3 is an exploded perspective view of the cosmetic container.

FIG. 4 is a longitudinal sectional view taken along line 4-4 of FIG. 1.

FIG. 5 is a perspective view of a bottom surface of an outer cover constituting a cosmetic container according to an embodiment of the present invention.

FIG. 6 is a front perspective view of a frame constituting a cosmetic container according to an embodiment of the present invention.

FIG. 7 is a rear perspective view of the frame.

FIG. 8 is a bottom perspective view of the frame.

FIG. 9 is a plan perspective view of a palette ring constituting a cosmetic container according to an embodiment of the present invention.

FIG. 10 is a bottom perspective view of the palette ring.

FIG. 11 is a perspective view of a palette constituting a cosmetic container according to an embodiment of the present invention.

FIG. 12 is a plan perspective view of a stem constituting a cosmetic container according to an embodiment of the present invention.

FIG. 13 is a bottom perspective view of the stem.

FIG. 14 is a longitudinal sectional view taken along line 14-14 of FIG. 12.

FIG. 15 is a plan perspective view of a housing constituting a cosmetic container according to an embodiment of the present invention.

FIG. 16 is a bottom perspective view of the housing.

FIG. 17 is a longitudinal sectional view taken along line 17-17 of FIG. 15.

FIG. 18 is an exploded perspective view of a piston assembly constituting a cosmetic container according to an embodiment of the present invention.

FIG. 19 is a cross-sectional perspective view of the piston assembly taken along line 19-19 of FIG. 18 in a state in which the piston assembly and a piston body constituting the piston assembly are separated.

FIG. 20 is a longitudinal sectional view of the piston assembly taken along line 19-19 of FIG. 18 in a state in which the piston guide and the piston body are coupled.

FIG. 21 is a perspective view of an inner cover constituting a cosmetic container according to an embodiment of the present invention.

FIG. 22 is a longitudinal sectional view taken along line 22-22 of FIG. 21.

FIG. 23 is a perspective view of a disc valve constituting a cosmetic container according to an embodiment of the present invention.

FIG. 24 is a longitudinal sectional view of a disc valve taken along line 24-24 of FIG. 23.

FIG. 25 is a perspective view of an inner base constituting a cosmetic container according to an embodiment of the present invention.

FIG. 26 is an enlarged perspective view of portion A in FIG. 4.

FIG. 27 is a perspective view of a coupling body of an outer base and a push button constituting a cosmetic container according to an embodiment of the present invention.

FIG. 28 is a plan view of portion B in FIG. 27.

FIG. 29 is a longitudinal sectional view of a cosmetic container 10 in a state before use taken along 29-29 of FIG. 1.

FIG. 30 is an enlarged view of portion C in FIG. 29.

FIG. 31 is a longitudinal sectional view of a cosmetic container in use taken along 29-29 of FIG. 1.

FIG. 32 is an enlarged view of portion D in FIG. 30.

FIG. 33 is a bottom perspective view of a housing constituting a cosmetic container according to an embodiment of the present invention.

FIG. 34 is a perspective view of a disc valve according to another embodiment of the present invention.

FIG. 35 is a cut perspective view taken along line 35-35 of FIG. 34.

FIG. 36 is a longitudinal sectional view of a cosmetic container according to another embodiment of the present invention showing a state before use.

FIG. 37 is an enlarged perspective view of portion E in FIG. 36.

FIG. 38 is an enlarged view of portion F in FIG. 36.

FIG. 39 is a longitudinal sectional view of a cosmetic container according to another embodiment of the present invention showing a use state.

FIG. 40 is an enlarged sectional view of portion G in FIG. 39.

FIG. 41 is an appearance perspective view of a piston body according to another embodiment of the present invention.

FIG. 42 is an appearance perspective view of a disc valve according to still another embodiment of the present invention.

FIG. 43 is a longitudinal sectional view taken along line 43-43 of FIG. 42.

FIG. 44 is a partial longitudinal sectional view showing a use state of a cosmetic container in which the piston body and the disc valve described in FIGS. 41 to 43. are mounted.

DETAILED DESCRIPTION OF THE EMBODIMENTS

Hereinafter, a structure and function of a cosmetic container according to an embodiment of the present invention will be described in detail with reference to drawings.

FIG. 1 is a perspective view in a state in which a cover of a cosmetic container according to an embodiment of the present invention is closed, FIG. 2 is a perspective view in a state in which the cover of the cosmetic container is opened, and FIG. 3 is an exploded perspective view of the cosmetic container, and FIG. 4 is a longitudinal sectional view taken along line 4-4 of FIG. 1.

Referring to FIGS. 1 to 4, the cosmetic container 10 according to an embodiment of the present invention may include an outer substrate 11, an inner base 14, a hinge shaft 12, a push button 13, a disc valve 15, an inner cover 16, a piston assembly 29 including a piston guide 18 and a piston body 17, a housing 19, an elastic member 20, a stem 21, a gasket 22, a palette 23, a palette ring 24, a frame 25, a mirror 26, an outer cover 27, and a pressing member 28.

In detail, the outer substrate 11 and the inner substrate 14 may be defined as a base member.

The hinge shaft 12 rotatably connects the outer cover 27 to one side surface of the outer base 11. That is, the hinge shaft 12 becomes a center of rotation of the outer cover 27.

In addition, the housing 19 is formed in a substantially n-shape, and a lower end portion thereof is placed on an edge of an upper surface of the inner base 14 to form a main storage space S1 in which cosmetics are stored. Further, a side surface of the housing 19 is engaged with a side surface of the inner base 14 to prevent the cosmetics stored in the main storage space S1 from leaking outside, and allows the main storage space S1 to be maintained at atmospheric pressure or a pressure lower than atmospheric pressure.

Furthermore, the inner cover 16 is disposed in the main storage space S1 and covers an upper surface of a cosmetic solution injected into the main storage space S1. Furthermore, as the cosmetic solution injected into the main storage space S1 is consumed and a level thereof is lowered, the inner cover 16 is moved down together.

In addition, the housing 19 may include a support sleeve 192, a center sleeve 193, and a partition plate 191 connecting upper end portions of the support sleeve 192 and the center sleeve 193, which will be described in detail in FIG. 15.

Further, the elastic member 20 is placed on an upper surface of the center sleeve 193, and the disc valve 15 is mounted on a lower end thereof. Furthermore, the piston assembly 29 is disposed inside the center sleeve 193 so as to be movable up and down. Here, a space in which the piston guide 18 constituting the piston assembly 29 is accommodated may be defined as a temporary storage space S2. In addition, the disc valve 15 is operated by moving up and down the piston assembly 29, so that the cosmetic solution stored in the main storage space S1 selectively flows into the temporary storage space S2. Further, the cosmetic solution that has flowed into the temporary storage space S2 is discharged to an upper surface of the stem 21 by passing through the piston assembly 29 in a state in which the piston assembly 29 is moved down.

In addition, the piston body 17 constituting the piston assembly 29 is fixedly mounted on a bottom surface of the stem 21 and moves up and down integrally with the stem 21.

Further, the gasket 22 and the palette 23 are coupled to the upper surface of the stem 21, and the palette ring 24 is coupled to the upper surface of the stem 21. Furthermore, an edge of the stem 21 is coupled to an inner circumferential surface of the frame 25 so as to be movable up and down. Therefore, when a user presses a center portion of the palette 23 with a puff, the palette ring 24, the palette 23, the stem 21, and the piston assembly 29 are integrally moved up and down. In addition, a protrusion and groove structure for restricting an elevating length of the stem 21 may be formed on the stem 21 and the frame 25.

Furthermore, the mirror 26 may be mounted on a bottom surface of the outer cover 27.

Hereinafter, each component constituting the cosmetic container 10 will be described in more detail with reference to drawings.

FIG. 5 is a perspective view of a bottom surface of an outer cover constituting a cosmetic container according to an embodiment of the present invention.

Referring to FIG. 5, the outer cover 27 constituting the cosmetic container 10 according to an embodiment of the present invention includes a plate-shaped upper surface portion 271, a side surface portion 272 extending downward from an edge of the upper surface portion 271, and the side surface portion 272, and a hinge fastening portion 273 further extending from a lower end of the side surface portion 272.

In detail, the mirror 26 may be mounted on a bottom surface of the upper surface portion 271. In addition, a locking protrusion 276 (see also the cross-sectional view of FIG. 4) may protrude from the side surface portion 272, which is opposite to the hinge fastening portion 273. Further, the hinge fastening portion 273 is formed with a pressure member placing portion 275 for placing the pressure member 28 to be recessed therein, and a hinge hole 274 in which the hinge shaft 12 is inserted is formed at a lower end of the hinge fastening portion 273.

In more detail, the pressure member 28 may be made of rubber or a silicone material having a predetermined elastic force. In addition, the pressure member 28 may protrude from the side surface portion 272 toward the center of the outer cover 27 to be squeezed to a pressure member adhering portion 255 of the frame 25 (see FIG. 7).

As shown in the cross-sectional view of FIG. 4, in a state in which the locking protrusion 276 is hung on the push button 13, the pressure member 28 is maintained in a state of being squeezed to the frame 25. Therefore, a restoring force F for returning to the original state acts on the pressure member 28 in an outer direction of the outer cover 27.

In addition, the restoring force F acts at a position spaced apart from the hinge shaft 12 by a predetermined distance r, so that a moment M ($M=r\times F$) about the hinge shaft 12 acts on the outer cover 27.

With such a structure, when a user presses the push button 13 and the locking protrusion 276 is separated from the push button 13, the outer cover 27 is opened while rotating about the hinge shaft 12 by the moment (clockwise direction in FIG. 4).

FIG. 6 is a front perspective view of a frame constituting a cosmetic container according to an embodiment of the present invention, FIG. 7 is a rear perspective view of the frame, and FIG. 8 is a bottom perspective view of the frame.

Referring to FIGS. 6 to 8, the frame 25 of the cosmetic container 10 according to an embodiment of the present invention is formed in a circular band shape in which a palette accommodating hole 256 is formed inside thereof. However, it is noted that the frame 25 may be formed in other shapes that are not a circular shape depending on the overall shape of the cosmetic container 10.

In detail, the frame 25 may include an upper frame 251 rounded concavely from the inside toward the outside, and a lower frame 252 extending downward from a bottom surface of the upper frame 251. The lower frame 252 extends at a position spaced apart a predetermined distance inward from an outer end of the upper frame 251.

An inner side surface of the lower frame 252 is spaced apart a predetermined distance outward from that of the upper frame 251, and an outer side surface of the lower frame 252 is spaced apart a predetermined distance inward from that of the upper frame 251. That is, the lower frame 252 extends at some position between the inner side surface and the outer side surface of the upper frame 251.

A hinge fastening portion accommodating groove 254 is formed to be recessed in an outer edge of the upper frame 251, and a pressure member adhering portion 255 is further formed to be recessed from the hinge fastening portion accommodating groove 254. In addition, an end portion of the pressure member 28 described above is squeezed to the pressure member adhering portion 255.

Further, a push button accommodating groove 253 is formed to be recessed at the outer edge of the upper frame 251, which is opposite to the hinge fastening portion accommodating groove 254. The push button 13 is accommodated in the push button accommodating groove 253, and thus it is possible to prevent the push button 13 from interfering with the frame 25 during operation.

In addition, a plurality of fastening grooves 252*a* may be formed to be recessed on an outer circumferential surface of the lower frame 252. A fastening protrusion 113 (see FIG. 27) protruding from the outer base 11 is fitted into the fastening groove 252*a* so that the frame 25 is fixed to the outer base 11.

Further, a plurality of guide grooves 251*a* may be formed to be recessed on an inner circumferential surface 251*b* of the upper frame 251. Furthermore, a plurality of guide protrusions 214 (see FIG. 12) protruding from an outer circumferential surface of the stem 21 are accommodated in the plurality of guide grooves 251*a*. In addition, a height of the plurality of guide grooves 251*a* corresponds to a moving displacement of the stem 21. That is, when a user presses the stem 21 with a puff, the plurality of guide protrusions 214 are moved down until they are in contact with a lower end of the guide groove 251*a*, and when pressing force is released, the plurality of guide protrusions 214 are moved up until they are in contact with an upper end of the guide groove 251*a* by a restoring force of the elastic member 20.

Further, a plurality of support protrusions 252*b* may be formed protruding from an inner circumferential surface of the lower frame 252 in a circumferential direction. A frame locking rib 192*a* (see FIG. 15) protruding from an outer circumferential surface of the housing 19 is placed on an upper surface of the plurality of support protrusions 252*b*. Therefore, the housing 19 is maintained in a state of being hung and fixed to the frame 25.

Furthermore, an end flange portion 251*c* that reaches the outer circumferential surface of the lower frame 252 from an outer end portion of the upper frame 251 is placed at an upper end portion of the outer base 11 to maintain the fixed state.

When the user presses a center portion of an upper surface of the palette 23 by using the puff, the frame 25 and the housing 19 are maintained in a fixed state, and are not moved down by the pressing force. That is, the frame 25 is maintained in a state of being placed at an upper end of the outer base 11, and the housing 19 fixedly coupled to the frame 25 is also integrally fixed to the frame 25.

FIG. 9 is a plan perspective view of a palette ring constituting a cosmetic container according to an embodiment of the present invention, and FIG. 10 is a bottom perspective view of the palette ring.

Referring to 9 and 10, the palette ring 24 constituting the cosmetic container 10 according to an embodiment of the present invention is fitted into the palette accommodating hole 256 formed on an inner side of the frame 25, and is provided inside the frame 25 so as to be movable up and down.

In detail, a palette accommodating hole 243 for accommodating the palette 23 is formed inside the palette ring 24. The palette ring 24 includes an inclined portion 241 inclined upward from an edge of the palette accommodating hole 243 toward an outer side thereof, and an extending portion 242 bent and extending at an end portion of the inclined portion 241.

The inclined portion 241 may be inclined in a straight line or inclined slightly rounded concavely. The extending portion 242 may be smoothly bent at an outer end portion of the inclined portion 241, and may be bent at an angle between a vertical surface and a horizontal surface.

In addition, a plurality of stem fastening protrusions 244 may protrude from a bottom surface of the inclined portion 241. The plurality of stem fastening protrusions 244 are fitted into fastening holes 212*a* (see FIG. 12) formed in the stem 21, so that the palette ring 24 and the stem 21 are integrally coupled. Therefore, the palette ring 24 and the stem 21 are integrally moved up and down by pressure of pressing the palette 23.

FIG. 11 is a perspective view of a palette constituting a cosmetic container according to an embodiment of the present invention.

Referring to FIG. 11, a palette 23 constituting the cosmetic container 10 according to an embodiment of the present invention has a circular plate shape.

In detail, the palette 23 is fitted into the palette accommodating hole 243 formed inside the palette ring 24. In addition, a plurality of outlets 232 may be formed on an inside thereof.

In more detail, the plurality of outlets 232 are holes through which a liquid cosmetic transferred to the temporary storage space S2 is discharged to the outside, and the cosmetic discharged through the outlet 232 is permeated into the puff. As shown in the drawing, the plurality of outlets 232 may be disposed at a predetermined distance from the center of the palette 23 in the radial direction.

In addition, one or a plurality of protrusion accommodating holes 231 may be formed at an edge of the palette 23. A fixing protrusion 215 (see FIG. 12) formed on the upper surface of the stem 21 is fitted into the protrusion accommodating hole 231. Therefore, the palette 23 is coupled to the stem 21 and moves up and down integrally with the stem 21.

FIG. 12 is a plan perspective view of a stem constituting a cosmetic container according to an embodiment of the present invention, FIG. 13 is a bottom perspective view of the stem, and FIG. 14 is a longitudinal sectional view taken along line 14-14 of FIG. 12.

Referring to FIGS. 12 to 14, the stem 21 constituting the cosmetic container according to an embodiment of the present invention moves in a vertical direction while being connected to an inner peripheral surface of the frame 25 by pressing force pressing the palette 23.

In detail, the palette 23 is placed on the upper surface of the stem 21, and the fixing protrusion 215 is fitted into the protrusion accommodating hole 231 of the palette 23 as described above.

In addition, the stem fastening protrusion 244 protruding from a bottom surface of the palette ring 24 is fitted into the fastening hole 212*a*, so that the palette ring 24 is fixedly coupled to the upper surface of the stem 21. Therefore, the palette 23, the palette ring 24, and the stem 21 move up and down integrally.

Meanwhile, the stem 21 may include a palette placing portion 211 on which the palette 23 is placed, an inclined portion 212 extending obliquely upward from an edge of the palette placing portion 211, and an extending portion 213 bent and extending from an end portion of the inclined portion 212.

The inclined portion 241 of the palette ring 24 may be placed on an upper surface of the inclined portion 212, and the extending portion 242 of the palette ring 24 may be placed on an upper surface of the extending portion 213.

In addition, a plurality of guide protrusions 214 may protrude from a side surface of the extending portion 213, and the plurality of guide protrusions 214 are fitted into the guide groove 251*a* formed on the inner circumferential surface of the frame 25. Further, the plurality of guide protrusions 214 are vertically moved inside the guide groove 251*a*.

The plurality of guide protrusions 214 may include a plurality of large guide protrusions disposed in the circumferential direction at a predetermined distance, and a plurality of small guide protrusions disposed between the large guide protrusions.

A plurality of fastening holes 212*a* are formed in the inclined portion 212, and the stem fastening protrusions 244 are fitted and coupled to the fastening holes 212*a* as described above.

In addition, an outlet 211*b* may be formed at the center of the palette placing portion 211 so that cosmetics in the temporary storage space S2 are discharged to the upper surface of the stem 21. Further, a plurality of guide flow paths 211*c* may be formed to extend in the radial direction around the outlet 211*b*. The plurality of guide flow paths 211*c* may be recessed from the upper surface of the stem 21 by a predetermined depth, and may be formed in a lattice shape.

In detail, the plurality of guide flow paths 211*c* may include a plurality of first guide flow paths in a form of a plurality of concentric circles having different diameters around the outlet 211*b*, and a plurality of second guide flow paths in a form of a straight line dividing the plurality of concentric circles passing through the outlets 211*b*. In addition, the plurality of outlets 232 may be disposed along any one or both of the first guide flow path and the second guide flow path.

As described above, the plurality of outlets 232 are formed along the guide flow path 211*c*, and thus it is possible to minimize that a cosmetic solution discharged through the outlet 211*b* is dispersed to another place so that the discharge resistance may be minimized.

Meanwhile, a gasket placing groove 211*a* for placing the gasket 22 may be formed to be recessed on an upper surface of the palette placing portion 211 corresponding to the outside of the guide flow path 211*c*. The gasket 22 is provided in order to prevent a liquid cosmetic discharged through the outlet 211*b* and flowing along the guide flow path 211*c* from leaking to the outside of the stem 21. The gasket 22 may be made of any one of silicone, rubber, sponge and nonwoven fabric.

In addition, the stem 21 may include a cylindrical shaped outer sleeve 216 extending by a predetermined length from a bottom surface of the palette placing portion, and an inner sleeve 217 extending to the same length as the outer sleeve 216 inside the outer sleeve 216. The centers of the outer sleeve 216 and the inner sleeve 217 coincide with the center of the outlet 211*b*.

Further, a locking hook 216*a* may be formed to protrude in the radial direction of the outer sleeve 216 at an end portion of the outer sleeve 216. A function of the locking hook 216*a* will be described in more detail below.

In detail, an upper sleeve accommodating groove 219 is formed inside the inner sleeve 217. The upper sleeve accommodating groove 219 is fitted with an upper sleeve 181*a* (see FIG. 20) of the piston guide 18 constituting the piston assembly 29.

A piston body fastening groove 218 is formed on an upper surface of the upper sleeve accommodating groove 219. The piston body fastening groove 218 is formed to be further recessed upward from the upper surface of the upper sleeve accommodating groove 219, and an upper end portion of the piston body 17 is fitted into the piston body fastening groove 218. In addition, the upper surface of the piston body fastening groove 218 communicates with the outlet 211*b*.

FIG. 15 is a plan perspective view of a housing constituting a cosmetic container according to an embodiment of the present invention, FIG. 16 is a bottom perspective view of the housing, and FIG. 17 is a longitudinal sectional view taken along line 17-17 of FIG. 15.

Referring to FIGS. 15 to 17, the housing 19 constituting the cosmetic container 10 according to an embodiment of the present invention is coupled to the inner base 14 to form the main storage space S1 therein.

In detail, the housing 19 may include a cylindrical-shaped center sleeve 193, a cylindrical-shaped support sleeve 192 having a diameter larger than that of the center sleeve 193, and a partition plate 191 connecting an upper end portion of the center sleeve and an upper end portion of the support sleeve 192.

The partition plate 191 may be made of a metal member such as stainless steel, and the center sleeve 193 and the support sleeve 192 may be made of a plastic material such as polypropylene. Further, the center sleeve 193 and the support sleeve 192 may be integrally molded by insert injection on the inside and the outside of the partition plate 191.

In addition, a coupled body of the stem 21 and the palette ring 24 is placed on an upper surface of the partition plate 191. Further, as shown in FIG. 29, an upper surface of an edge portion of the partition plate 191 is in close contact with a bottom surface of the frame 25. That is, the frame 25 is placed on an upper surface of the housing 19, and the inner circumferential surface of the lower frame 252 is coupled to be in close contact with an outer circumferential surface of the support sleeve 192.

In detail, an elastic member placing groove 193*a* is formed to be recessed downward on the upper surface of the center sleeve 193, and a disc valve coupling portion 194 is formed to be recessed upward on a bottom surface of the center sleeve 193. The elastic member placing groove 193*a* and the disc valve coupling portion 194 are formed to be recessed to a depth that does not communicate with each other. That is, a lower end portion of the elastic member placing groove 193*a* and an upper end portion of the disc valve coupling portion 194 may be defined as an upper surface and a lower surface of a partition wall 193*e*.

The elastic member placing groove 193*a* and the disc valve coupling portion 194 are formed to be recessed in the center sleeve 193 in opposite directions to each other, so that the center sleeve 193 is again divided into an inner first sleeve 193*b* inside thereof and a second sleeve 193*c* outside thereof. Further, the first sleeve 193*b* and the second sleeve 193*c* may be configured to be connected to each other by the partition wall 193*e*.

Here, a lower end portion of the second sleeve 193*c* is formed to be shorter than a lower end portion of the first sleeve 193*b*, as shown in FIG. 26, because a depression portion 144 (see FIG. 25) is formed in a central portion of the inner base 14. That is, the first sleeve 193*b* is in contact with the depression portion 144, and the second sleeve 193*c* is in contact with a bottom portion of the inner base 14 corresponding to an outer side of the depression portion 144.

The coil-shaped elastic member 20 is placed in the elastic member placing groove 193*a*. Further, an upper end of the elastic member 20 more protrudes upward than the partition plate 191 so that the stem 21 is placed at the upper end of the elastic member 20.

In addition, when the stem 21 is pressed, the elastic member 20 is compressed until the bottom surface of the stem 21 is close contact with the upper surface of the partition plate 191. Here, a pumping space in an atmospheric pressure state is formed between the stem 21 and the partition plate 191, and one or a plurality of air holes 191 are formed in the partition plate 191. Further, the inner cover 16 is positioned directly below the partition plate 191.

As a level of a cosmetic solution stored in the main storage space S1 is higher, the inner cover 16 is positioned closer to the partition plate 191, and as the level of the cosmetic solution is lowered, the inner cover 16 moves down to approach the inner base 14.

Further, the main storage space S1 is divided into a first space between an upper surface of the inner cover 16 and the partition plate 191 and a second space between the inner cover 16 and the inner base 14 by the inner cover 16. Furthermore, the second space is maintained at a pressure lower than the atmospheric pressure, and is filled with the cosmetic solution.

On the other hand, the first space communicates with the pumping space through the air hole 191*a*. That is, the first space is always maintained in an atmospheric pressure state by the air hole 191*a*. Therefore, when the level of the cosmetic solution is lowered, the inner cover 16 moves down by not only load of the inner cover 16 but also pressure difference between the first space and the second space as the level of the cosmetic solution is lowered.

Meanwhile, a frame locking rib 192*a* protrudes at an upper side of the outer circumferential surface of the support sleeve 192, and is wrapped in a band shape. Further, an inner base locking rib 192*b* protrudes at the outer circumferential surface of the support sleeve 192 which is spaced downward from the frame locking rib 192*a*, and is wrapped in a band shape.

As described above, when the frame 25 is assembled, the frame locking rib 192*a* is placed on the upper surface of the support protrusion 252*b* protruding from the inner circumferential surface of the lower frame 252, and is locked to the support protrusion 252*b* so that the frame 25 and the housing 19 are coupled integrally.

In addition, the inner base locking rib 192*b* is inserted into a band-shaped locking groove 142*a* (see FIG. 25) formed on the inner circumferential surface of a side surface portion of the inner base 14 so that the inner base 14 and the housing 19 are coupled integrally.

Further, a plurality of placing ribs 192*c* may be formed to protrude in parallel at positions facing each other on the outer circumferential surface of the support sleeve 192. Furthermore, the plurality of placing ribs 192*c* may be placed on a placing flange 142*b* (see FIG. 25) formed on the inner base 14.

Meanwhile, a plurality of inlets 195 may be formed to be recessed in the lower end portions of the first sleeve 193*b* and the second sleeve 193*c*, and may be disposed to be spaced apart from each other in the circumferential direction of the center sleeve 193. In addition, a first inlet 195*a* formed in the first sleeve 193*b* and a second inlet 195*b* formed in the second sleeve 193*c* are arranged in the center direction of the center sleeve 193, so that a flow resistance generated when the cosmetic solution flows into the temporary storage space S2 from the main storage space S1 may be minimized.

In addition, a protrusion portion 194*a* and a depression portion 194*b* may be alternately formed in the disc valve coupling portion 194, and the depression portion 194*b* may be aligned with the inlet 195.

Further, a piston guide accommodating groove 193*d* is formed inside the first sleeve 193*b* (or inside the center sleeve). A locking flange 196 protrudes toward the center of the first sleeve 193*b* at an upper end of the first sleeve 193*b* so that a rising height of the piston guide 18 accommodated in the piston guide accommodating groove 193*d* may be restricted (see FIG. 4 or FIG. 20).

Furthermore, a stem locking rib 197 further protrudes from an inner circumferential surface of the locking flange 196 toward the center of the first sleeve 193*b* so that the locking hook 216*a* protruding from the end portion of the outer sleeve 216 is locked to the stem locking rib 197. Then, as shown in FIG. 4 (or FIG. 20), when the locking hook 216*a* is locked to the stem locking rib 197, the stem 21 is not separated from the housing 19 by the restoring force of the elastic member 20.

In addition, one or a plurality of fitting grooves 193*f* may be formed to be recessed on an outer circumferential surface of the first sleeve 193*b*.

FIG. 18 is an exploded perspective view of a piston assembly constituting a cosmetic container according to an embodiment of the present invention, FIG. 19 is a cross-sectional perspective view of the piston assembly taken along line 19-19 of FIG. 18 in a state in which a piston guide and a piston body constituting the piston assembly are separated, and FIG. 20 is a longitudinal sectional view of the piston assembly taken along line 19-19 of FIG. 18 in a state in which the piston guide and the piston body are coupled.

Referring to FIGS. 18 to 20, the piston assembly 29 constituting the cosmetic container 10 according to an embodiment of the present invention may include the piston body 17 and the piston guide 18 fitted into an outer peripheral surface of the piston body 17.

In detail, the piston body 17 includes a vertical cylindrical-shaped piston sleeve 171 in which a flow path is formed, and a flange 172 bent and extending at a lower end portion of the piston sleeve 171.

The flange 172 may extend in the horizontal direction and be inclined or bent upward. A lower sleeve contact surface 173 is formed at a corner in which the piston sleeve 171 and the flange 172 intersect.

In addition, an inlet 171*a* into which a cosmetic solution collected in the temporary storage space S2 flows is formed in a side surface of the piston sleeve 171. An outlet 171*b* through which the cosmetic solution flowed into the inlet 171*a* is discharged is formed in an inner center of the piston sleeve 171. Further, the outlet 171*b* communicates with a discharge port 211*b* formed at the center of the stem 21.

Further, a locking protrusion 171*c* is wrapped protruding in a band shape on an outer circumferential surface of an upper end portion of the piston sleeve 171, and the locking protrusion 171*c* is fitted into the piston body fastening groove 218 formed in the stem 21.

Meanwhile, the piston guide 18 may include a guide sleeve 181 through which the piston sleeve 171 passes, a guide plate 182 extending from an outer circumferential surface of the guide sleeve 181 in a disc shape, and a lip portion 183 formed at an end portion of the guide plate 182.

In detail, the guide sleeve 181 may include an upper sleeve 181*a* extending upward from an upper surface of the guide plate 182 and a lower sleeve 181*b* extending downward from a lower surface of the guide plate 182.

The upper sleeve 181*a* moves up or down in the upper sleeve accommodating groove 219 formed in the inner sleeve 217 of the stem 21. In addition, an adhering protrusion 181*c* protrudes from an outer circumferential surface of an upper end portion of the upper sleeve 181*a*, and may be wrapped around an outer circumferential surface of the upper sleeve 181*a* in a band shape. Further, the adhering protrusion 181*c* is maintained in contact with an inner circumferential surface of the upper sleeve accommodating groove 219 when the piston guide 18 moves up or down.

In addition, the lip portion 183 may include an upper lip 183*a* extending obliquely upward from the end portion of the guide plate 182, and a lower lip 183*b* extending obliquely downward from the end portion of the guide plate 182.

The guide plate 182 is accommodated in the piston guide accommodating groove 193*d* formed in the housing 19. In addition, when the piston guide 18 moves up or down, the lip portion 183 is maintained in close contact with an inner circumferential surface of the piston guide accommodating groove 193*d*.

By forming the lip portion 183, it is possible to prevent the cosmetic solution stored in the temporary storage space S2 from flowing into the upper sleeve accommodating groove 219. In addition, the lip portion 183 is composed of the upper lip 183*a* and the lower lip 183*b*, so that leakage of the cosmetic solution may be prevented double. That is, leakage is primarily prevented at the lower lip 183*b*, and leakage is secondarily prevented at the upper lip 183*a*, thereby preventing the cosmetic solution from flowing into the upper sleeve accommodating groove 219.

In addition, a lower end portion of the lower sleeve 181*b* may be selectively in contact with or separated from the flange 172 in accordance with an operation of pressing the palette 23. That is, in a state in which the lower end portion of the lower sleeve 181*b* is in contact with the lower sleeve contact surface 173, the cosmetic solution collected in the temporary storage space S2 may not be discharged to the outside. Conversely, when the piston body 17 moves down and separates from the lower end portion of the lower sleeve

181*b* from the lower sleeve contact surface 173, the cosmetic solution collected in the temporary storage space S2 is discharged to the outside.

In the drawing, it is shown that the lower inner circumferential surface of the lower sleeve 181*b* is in contact with the outer surface of the flange 172, but the lower end portion of the lower sleeve 181*b* may be in contact with or separated from an upper surface of the flange 172.

FIG. 21 is a perspective view of an inner cover constituting a cosmetic container according to an embodiment of the present invention, and FIG. 22 is a longitudinal sectional view taken along line 22-22 of FIG. 21.

Referring to FIGS. 21 and 22, as described above, the inner cover 16 constituting the cosmetic container 10 is disposed inside the main storage space S1 defined by the housing 19 and the inner base 14. In addition, the more cosmetic solution filled in the main storage space S1, the closer to a bottom of the housing 19, and as the cosmetic solution decreases, the inner cover 16 moves down and approaches the inner base 14.

In addition, an upper space of the inner base 14 communicates with the pumping space maintained in an atmospheric pressure state through the air hole 191*a* of the housing 19, thereby maintaining the atmospheric pressure state (see an arrow in FIG. 17), and a lower space of the inner base 14 is maintained in a pressure state lower than the atmospheric pressure.

Further, a center sleeve through-hole 161 is formed in the center of the inner base 14, and the center sleeve 193 extending from the bottom surface of the housing 19 is inserted through the center sleeve through-hole 161. Furthermore, an end portion of the inner base 14 may be formed with a lip portion 164 having the same shape and the same function as the lip portion 183 formed in the piston guide. The lip portion 164 may include an upper lip 164*a* and a lower lip 164*b*. The lip portion 164 maintains an airtight state such that a lower space of the inner cover 16 is completely separated from an upper space thereof during moving down of the inner cover 16.

FIG. 23 is a perspective view of a disc valve constituting a cosmetic container according to an embodiment of the present invention, and FIG. 24 is a longitudinal sectional view of a disc valve taken along line 24-24 of FIG. 23.

Referring to FIGS. 23 and 24, the disc valve 15 constituting the cosmetic container 10 according to an embodiment of the present invention may be made of a flexible plastic, silicone or rubber material which may be warped by a pressure difference.

In detail, the disc valve 15 may be formed in an annular band shape having a hollow portion therein. An inner diameter of the disc valve 15 may be formed larger than an outer diameter of the piston assembly 29, specifically, the piston guide 18.

In other words, the disc valve 15 is placed outside a region in which the piston assembly 29 is moved down by pressing force of a user, so that a phenomenon of interference of the lower end portion of the piston assembly 29 and the disc valve 15 may be completely removed. As a result, it is possible to obtain an effect that a thickness of the cosmetic container 10 in the vertical direction may be further reduced.

In the related art, a check valve, which serves as a disc valve, is positioned directly below a moving up and down region of the piston assembly 29, and thus it was necessary to ensure a space in the vertical direction corresponding to a thickness of the check valve and a check valve supporting structure. Therefore, there was a limit in reducing the overall thickness of the cosmetic container.

However, in case of the present invention, the disc valve 15, which serves as the check valve, is disposed outside the moving up and down region of the piston assembly 29, and thus there is an effect that the overall thickness of the cosmetic container 10 may be further reduced.

Meanwhile, the disc valve 15 is mounted on a lower end of the center sleeve 193 constituting the housing 19. In detail, a disc valve coupling portion 194 is formed to be recessed at the lower end of the center sleeve 193. In addition, a protrusion portion 194*a* and a depression portion 194*b* are alternately formed at an upper end of the disc valve coupling portion 194.

In addition, the disc valve 15 may include a fixing portion 151 extending in the horizontal direction and a flap portion 152 extending downward from an outer end portion of the fixing portion 151. The flap portion 152 may extend vertically from the fixing portion 151, and may be formed to be curved toward the center of the disc valve 15 as it goes to the lower side as shown in the drawing.

Further, a protrusion portion 153 and a depression portion 154 may be alternately formed on an upper surface of the fixing portion 151, and the protrusion portion 153 may be fitted into the depression portion 194*b* formed in the disc valve coupling portion 194, and the protrusion portion 194*a* formed in the disc valve coupling portion 194 may be fitted into the depression portion 154. By such a coupling relationship between the protrusion portion and the depression portion, it is possible to prevent the disc valve 15 from idling in the circumferential direction of the disc valve 15.

Furthermore, one or a plurality of fitting protrusions 155 may be formed protruding on an inner circumferential surface of the fixing portion 151, and the one or the plurality of fitting protrusions 155 may be fitted into a fitting groove 196 formed in the first sleeve 193*b*, so that it is possible to prevent the disc valve 194 from idling in the circumferential direction.

Here, the fixing portion 151 may be formed to be relatively harder than the flap portion 152 in order to strengthen the coupling force, and the flap portion 152 may be relatively flexible so as to be easily warped by flow pressure of the cosmetic solution. That is, flexibility of the fixing portion 151 and the flap portion 152 may be molded the same, but the flap portion 152 may be molded more flexibly than the fixing portion 151.

FIG. 25 is a perspective view of an inner base constituting a cosmetic container according to an embodiment of the present invention, and FIG. 26 is an enlarged perspective view of portion A in FIG. 4.

Referring to FIGS. 25 and 26, the inner base 14 constituting the cosmetic container 10 according to an embodiment of the present invention may include a bottom portion 141 and a side surface portion 142 extending upward from an edge of the bottom portion 141.

In detail, a depression portion 144 having a predetermined diameter may be formed in a central portion of the bottom portion 141. Therefore, a locking flange 145 is formed between an edge of the depression portion 144 and the bottom portion 141.

In addition, as described above, the first sleeve 193*b* of the housing 19 is in contact with the depression portion 144, and the second sleeve 193*c* of the housing 19 is in contact with the bottom portion 141 corresponding to the outside of the depression portion 144.

Further, a plurality of guide protrusions 143 are formed to protrude along an edge of the depression portion 144 at the bottom portion 141 corresponding to the edge of the depression portion 144. As shown in the drawing, an inner side surface of the guide protrusion 143 is formed to be inclined to prevent the flap portion 152 from being warped outward of the depression portion 144 during assembly of the disc valve 15.

In detail, referring to a process of assembling the cosmetic container 10, the disc valve 15 is first mounted in a state in which the housing 19 is turned over, and then the inner base 14 is covered. Therefore, during covering the inner base 14, an inclined surface of the guide protrusion 143 guides the flap portion 152 such that the flap portion 152 of the disc valve 15 is positioned inside the depression portion 144. And then, an outer circumferential surface of the flap portion 152 is assembled to be in close contact with the locking flange 145. In addition, the flap portion 152 is warped in the center direction of the depression portion 144 by the flow pressure of the cosmetic solution flowing from the outside of the second sleeve 193*c* toward the first sleeve 193*b* through the inlet 195.

Meanwhile, a locking groove 142*a* is formed on an inner circumferential surface of the side surface portion 142, and a placing flange 142*b* is formed at an upper end thereof. In addition, the placing ribs 192*c* are placed on the placing flange 142*b*. The inner base locking rib 192*b* is inserted into the locking groove 142*a*.

FIG. 27 is a perspective view of a coupling body of an outer base and a push button constituting a cosmetic container according to an embodiment of the present invention, and FIG. 28 is a plan view of portion B in FIG. 27.

Referring to FIGS. 27 and 28, the outer base 11 constituting the cosmetic container 10 according to an embodiment of the present invention may include a bottom portion 111 and a side surface portion 112 extending upward from an outer edge portion of the bottom portion 111.

In detail, a hinge fastening portion fitting groove 112*b* is formed to be recessed at a predetermined depth downward at one side of the side surface portion 112, and a hinge hole 121*b* into which a hinge shaft 12 is fitted is formed at both sides of the hinge fastening portion fitting groove 112*b*.

Further, a mounting portion for mounting the push button 13 is formed at one point of the side surface portion 112 corresponding to a side opposite to the hinge fastening portion fitting groove 112*b*.

Here, the push button 13 may include a pressing portion 131, an arm portion 133 extending from both side ends of the pressing portion 131, and a locking hook 132 protruding from an upper surface of the pressing portion 131. In addition, a guide hole 133*a* may be formed in the arm portion 133.

Further, the mounting portion may include a pressing portion accommodating groove 116 in which the pressing portion 131 is accommodated, and an arm accommodating portion 114 extending from both side end portions of the pressing portion accommodating groove 116 in a circumferential direction of the side surface portion 112, a guide protrusion 116 protruding from an inner side surface of the arm accommodating portion 114 and fitted into the guide hole 133*a*, and an arm support rib 115 for supporting the arm portion 133.

The arm support rib 115 is bent and extending in an L-shape from an inner circumferential surface of the side surface portion 112 to support the end portion of the arm portion 133. Therefore, even though pressure is applied to the pressing portion 131, it is possible to prevent the push button 13 from being detached toward the inside of the outer base 11.

In addition, the guide protrusion 116 is fitted into the guide hole 133*a*, so that the push button 13 may be prevented from moving in left and right directions. The arm accommodating portion 114 is recessed from the inner circumferential surface of the side surface portion 112 by a depth corresponding to a thickness of the arm 133, and may be formed to be slightly longer than a length of the arm 133. Accordingly, even though the pressing portion 131 is pressed and the arm 133 is unfolded in a rounded state, it is possible to prevent the arm 133 from being damaged by interfering with the arm accommodating portion 114.

Meanwhile, the fastening protrusion 113 protrudes from the inner circumferential surface of the side surface portion 112, and the fastening protrusion 113 is fitted into the fastening grooves 252*a* formed on an outer circumferential surface of the lower frame 252.

Hereinafter, an operation method of the cosmetic container for discharging a cosmetic solution stored in the cosmetic container according to an embodiment of the present invention will be described with reference to drawings.

FIG. 29 is a longitudinal sectional view of a cosmetic container 10 in a state before use taken along 29-29 of FIG. 1, and FIG. 30 is an enlarged view of portion C in FIG. 29.

Referring to FIG. 29 and FIG. 30, a state in which the outer cover 25 is closed by the push button 13 is maintained in a state before use.

In detail, the outer cover 25 may be closed in a state in which a puff is placed on an upper surface of the palette 23, and the puff may be stored separately.

When no pressing force acts on the center of the upper surface of the palette 23, the stem 21 is maintained in a state of being spaced apart from the upper surface of the housing 19 by restoring force of the elastic member 20.

Further, a lower end portion of the outer sleeve 216 is maintained in a state of being spaced apart from an upper surface of a guide plate 182 of the piston guide 18. Further, the lower sleeve 181*b* is maintained in contact with the flange 172. The flap portion 152 of the disc valve 15 is maintained in a state of being in close contact with the locking flange 145 of the inner base 14. Therefore, a cosmetic solution stored in the temporary storage space S2 cannot be discharged to the outside, and is maintained in a closed state.

FIG. 31 is a longitudinal sectional view of a cosmetic container in use taken along 29-29 of FIG. 1, and FIG. 32 is an enlarged view of portion D in FIG. 30.

Referring to FIG. 31 and FIG. 32, first, a user presses the push button 13 to rotate the outer cover 25 in order to use cosmetics stored in a cosmetic container 10.

In this state, when a pressure P is applied to a center of the upper surface of the palette 23, the palette 23, the stem 21, the piston assembly 29 mounted on the bottom surface of the stem 21, and the palette ring 24 move down by a predetermined distance h.

At this time, the piston guide 18 does not move until the stem 21 moves down and the lower end portion of the outer sleeve 216 contacts the guide plate 182 of the piston guide 18, and only the piston body 17 moves down integrally with the stem 21. In addition, when the lower end portion of the outer sleeve 216 is in contact with the guide plate 182, the lower sleeve 181*b* is separated from the flange 172.

In this state, the piston guide 18, the piston body 17, and the stem 21 move down integrally. Further, as the stem 21 moves down, the elastic member 20 is compressed. Furthermore, the stem 21 moves down until it is in contact with the upper surface of the housing 19.

Meanwhile, when the outer sleeve 216 is separated from the flange 172, the cosmetic solution collected in the temporary storage space S2 flows into the inlet 171*a* of the piston body 17 through a space between the outer sleeve 216 and the flange 172. In addition, the cosmetic solution flowed into the inlet 171*a* is guided to the discharge port 211*b* through the outlet 171*b*.

Further, the cosmetic solution discharged through the discharge port 211*b* flows along the guide flow path 211*c* formed on the upper surface of the stem 21. Furthermore, the cosmetic solution flowing along the guide flow path 211*c* is discharged to the outside through the outlet 232, and permeated into the inside of the puff pressing the palette 23.

Meanwhile, when the cosmetic solution stored in the temporary storage space S2 is discharged to the outside, pressure of the temporary storage space S2 becomes lower than that of the main storage space S1. Then, a phenomenon occurs in which the cosmetic solution stored in the main storage space S1 flows into the temporary storage space S2 through the inlet 195 (see FIG. 26). That is, the cosmetic solution stored in the main storage space S1 presses the flap portion 152 of the disc valve 15 through the inlet 195. Accordingly, the flap portion 152 is warped inward and the inlet 195 is open, so that the cosmetic solution stored in the main storage space S1 flows into the temporary storage space S2.

Here, the cosmetic solution stored in the temporary storage space S2 is discharged to the outside until pressure P for pressing the palette 23 is removed by a user, and the cosmetic solution stored in the main storage space S1 moves to the temporary storage space S2.

In addition, when the user removes the pressure P, the piston body 17 moves up and the flange 172 closely contacts a lower end of the outer sleeve 216 to block the discharge of the cosmetic container. Further, an upper end portion of the piston guide 18 moves up until it reaches an upper end of the piston guide accommodating groove 193*d*.

In this state, the disc valve 15 is maintained in an open state until the temporary storage space S2 is filled with the cosmetic solution. In addition, when the temporary storage space S2 is filled with the cosmetic solution and becomes the same pressure as the main storage space S1, the flap portion 152 returns to its original position and is in close contact with the locking flange 145, and as a result, the disc valve 15 is closed.

Further, as the level of the cosmetic solution stored in the main storage space S1 is lowered, the inner cover 16 also moves down.

As shown in FIG. 32, the disc valve 15 is disposed outside a moving down region of the piston assembly 29, so that the flange 172 of the piston body 17 may be moved down to a very close distance to the bottom portion of the inner base 14, and there is an advantage of reducing a thickness of the cosmetic container by a corresponding distance.

FIG. 33 is a bottom perspective view of a housing constituting a cosmetic container according to another embodiment of the present invention.

The cosmetic container according to another embodiment of the present invention is the same in construction and operation as the cosmetic container 10 in the previous embodiment, but there is a slight difference in a structure of a housing and a disc valve. Therefore, redundant description of the same configuration and function is omitted.

In detail, a housing 39 according to another embodiment of the present invention, like the housing 19 according to the previous embodiment, may include a circular-shaped partition plate 391, a support sleeve 392 formed at an outer edge of the partition plate 391, and a center sleeve 393 formed at an inner edge of the partition plate 391. In addition, a plurality of air holes 391*a* may be formed in the partition plate 391.

Further, a frame locking rib 392*a* and an inner base locking rib 392*b* are formed on an outer circumferential surface of the support sleeve 392, which is the same as the housing 19 according to the previous embodiment. However, a difference is that a shape of a placing rib 392*c* formed on the outer circumferential surface of the support sleeve 392 is slightly different. That is, the previous embodiment has a structure in which a pair of placing ribs 192*c* extend downward in parallel, and conversely, as shown in the drawing, the placing rib 392*c* according to the present embodiment has a structure including a vertical portion and a horizontal portion formed a lower end of the vertical portion. Furthermore, a plurality of placing ribs 392*c* are disposed to be spaced apart from each other in the circumferential direction of the support sleeve 392, which is the same as the previous embodiment.

In addition, the center sleeve 393 is composed of a first sleeve 393*b* inside thereof and a second sleeve 393*c* outside thereof, and a piston guide accommodating groove 393*d* is formed inside the first sleeve 393*b*, and a locking flange 396 and a stem locking rib 397 are formed at an upper end the piston guide accommodating groove 393*d*, which is the same as the structure of the housing 19 according to the previous embodiment Further, the first sleeve 393*b* and the second sleeve 393*c* are partitioned by a partition wall 393*e*, and a disc valve coupling portion 394 is formed on a lower side of the partition wall 393*e*, and a protrusion portion 394*a* and a depression portion 394*b* are formed on a bottom surface of the partition wall 393*e* defining the disc valve coupling portion 394, which is the same as the previous embodiment.

However, a lower end portion of the first sleeve 393*b* is formed to be shorter than a lower end portion of the second sleeve 393*c*, which is contrary to the previous embodiment. This is due to structural features of a disc valve 35 according to another embodiment to be described later.

In the previous embodiment, since the first sleeve 193*b* is placed on the depression portion 144 formed at the center of the bottom portion of the inner base 14, and the second sleeve 193*c* is placed at the bottom portion of the inner base 14 which corresponds to the outside of the edge of the depression portion 144, the first sleeve 193*b* is formed longer than the second sleeve 193*c*, but in the present embodiment, an outer diameter of the second sleeve 193*c* is formed to be smaller than that of the previous embodiment, or a radius of the depression portion 144 is larger than that of the previous embodiment, so that the second sleeve 193*c* may be placed at an edge portion of the depression portion 144.

In addition, like the previous embodiment, a plurality of inlets 395 are formed to be recessed upward on a bottom portion of the second sleeve 193*c*, and the plurality of inlets 395 may be disposed to be spaced apart from each other in the circumferential direction of the second sleeve 193*c*.

However, unlike the previous embodiment, it is not necessary to form a separate inlet at a bottom portion of the first sleeve 393*b*, and this is due to a structure of the modified disc valve 35.

However, a plurality of restricting protrusions 393*e* protrude from the bottom portion of the first sleeve 393*b* to limit a warp angle (or moving-up angle) of the flap constituting the disc valve 35. The plurality of restricting protrusions 393*e* may be disposed in the circumferential direction of the first sleeve 393*b* in plural. At least, an outer side surface of the restricting protrusions 393*e* is formed to be inclined at a predetermined angle from a vertical surface so that the flap of the disc valve 35 may be brought into surface contact while being warped. An inner side surface of the restricting protrusion 393*e* may be formed to be inclined at a predetermined angle, but the present invention is not limited thereto.

Meanwhile, in the previous embodiment, a fitting groove 193*f* is formed in the outer circumferential surface of the first sleeve 193*b*, and when the disc valve 15 is mounted, a fitting protrusion 155 protrudes from an inner circumferential surface of the disc valve 15 corresponding to the fitting groove 193*f* to prevent the disc valve 15 from idling in the circumferential direction.

However, in the present embodiment, a flap portion is formed inside the disc valve 35, so that a fitting protrusion 393*f* protrudes from an inner circumferential surface of the second sleeve 393*c*, and a fitting groove 351*g* (see FIG. 34) is formed on an outer circumferential surface of the disc valve 35. Here, the fitting groove may be formed on the inner circumferential surface of the second sleeve 393*c*, and the fitting protrusion may be formed on the outer circumferential surface of the disc valve 35.

FIG. 34 is a perspective view of a disc valve according to another embodiment of the present invention, and FIG. 35 is a cut perspective view taken along line 35-35 of FIG. 34.

Referring to FIGS. 34 and 35, a disc valve 35 according to the present embodiment is different from the disc valve 15 according to the previous embodiment in that a flap warped by an operation of a piston assembly 29 is formed inside the disc valve 35.

In detail, the disc valve 35 includes a fixing portion 351 and a flap portion 352 that extends obliquely from an inner edge of the fixing portion 351. The fixing portion 351 may include a horizontal portion 351*b* formed in a circular band shape, an outer vertical portion 351*a* extending downward from a bottom surface of an outer edge of the horizontal portion 351*b*, and an inner vertical portion 351*c* extending downward from an inner edge of the horizontal portion 351*b*, and a plurality of protrusion portions 351*e* and a depression portions 351*f* formed on an upper surface of the horizontal portion 351*b*.

The flap portion 352 is molded more flexible than the fixing portion 351 like the previous embodiment.

The depression portion 351*f* is formed by a plurality of the protrusion portions 351*e* disposed to be spaced apart from each other in the circumferential direction of the horizontal portion 351*b*. Here, when the upper surface of the horizontal portion 351*b* is defined as an upper surface of the protrusion portion 351*e*, it may be described that the protrusion portions 351*e* are formed by disposing the plurality of depression portions 351*f* to be spaced apart from each other.

The outer vertical portion 351*a* may be defined as a plurality of pillars which are disposed to be spaced apart from each other in the circumferential direction of the horizontal portion 351*b*, and a space between adjacent outer vertical portions 351*a* may be defined as an inlet 351*d*. When a cosmetic solution flows into a lower side of the flap portion 352 through the inlet 351*d*, and the flap portion 352 is lifted by an operation of the piston assembly 29, the cosmetic solution positioned on the lower side of the flap portion 352 flows into the temporary storage space S2. A width of the inlet 351*d* may be formed to correspond to a width of an inlet 395 formed at a lower end of the second sleeve 393*c*.

Meanwhile, a bent portion 352*a* bent upward may be formed at an end portion of the flap portion 352. In addition, the flap portion 352 may be formed to be inclined at a predetermined angle θ from a vertical line passing through the inner vertical portion 351*c*. Further, the flap portion 352 extends to be inclined downward from the inner vertical portion 351*c*.

FIG. 36 is a longitudinal sectional view of a cosmetic container according to another embodiment of the present invention showing a state before use, FIG. 37 is an enlarged perspective view of portion E in FIG. 36, and FIG. 38 is an enlarged view of portion F in FIG. 36.

Referring to FIGS. 36 to 38, a bottom surface of the first sleeve 393*b* is not formed with an inlet because a flap portion 352 of the disc valve 35 is in contact therewith. Therefore, an inlet 395 is formed only on a bottom surface of the second sleeve 393*c*.

In addition, as described above, the second sleeve 393*c* is placed on a depression portion 144 of the inner base 14, specifically, at an edge portion of the depression portion 144. Further, so as to extend the flap portion 352 of the disc valve 35 to the inside of the temporary storage space S2, the first sleeve 393*b* is formed to be shorter than the second sleeve 393*c*.

Further, when the piston assembly 29 is not operated, a bottom surface of an end portion of the flap portion 352 is maintained in a state of being in contact with the depression portion 144.

FIG. 39 is a longitudinal sectional view of a cosmetic container according to another embodiment of the present invention showing a use state, and FIG. 40 is an enlarged sectional view of portion Gin FIG. 39.

Referring to FIGS. 39 and 40, when a user presses the palette 23 with a predetermined force P by a puff, the stem 21 and the piston assembly 29 are moved down by a predetermined height h. A pressure change in the main storage space S1 and temporary storage space S2 due to moving down of the piston assembly 29 has already been described in the previous embodiment, and thus redundant description is omitted.

A cosmetic solution in the temporary storage space S2 flows out while the flap portion 352 is lifted up due to moving down of the piston assembly 29. In addition, when the flap portion 352 is lifted up, the cosmetic solution in the main storage space S1 flows into the temporary storage space S2.

Here, since the flap portion 352 extends to be inclined from a vertical surface, the flap portion 352 is freely warped, and thus the cosmetic solution may be uniformly discharged. In addition, the restricting protrusion 393*e* formed on a bottom surface of a first sleeve 393*b* of the housing 39 prevents the flap portion 352 from being excessively lifted up, and as a result, the cosmetic solution may be prevented from being excessively discharged.

FIG. 41 is an appearance perspective view of a piston body according to another embodiment of the present invention.

Referring to FIG. 41, a structure of a piston body 17 according to the present embodiment is the same as that of the piston body 17 according to the previous embodiment shown in FIGS. 18 to 20, but there is a difference in that a plurality of through-holes 172*a* are formed in a flange 172. In detail, the through-hole 172*a* may be formed in a bottom portion of the flange 172. That is, the through-holes 172*a* may be formed in a portion horizontally extending from a lower end of the piston sleeve 171. In addition, the through-holes 172*a* may be disposed to be spaced apart from each other in the circumferential direction of the flange 172.

Further, it is noted that the through-hole 172*a* may be formed in the piston body 17 shown in FIGS. 18 to 20 as well.

According the plurality of through-holes 172*a* formed in the flange 172, when the piston body 17 moves down, the cosmetic solution stored in the temporary storage space S2 immediately passes through the through-hole 172*a*, and may be discharged outside the temporary storage space S2. As a result, there is an advantage that a flow resistance generated when the cosmetic solution is discharged is reduced, and a time taken for the cosmetic to be discharged when the palette 23 is pressed is shortened, that is, the so-called response time is shortened.

In the drawing, three through-holes 172*a* are shown as being formed in the flange 172*a*, but the present invention is not limited thereto.

FIG. 42 is an appearance perspective view of a disc valve according to still another embodiment of the present invention, and FIG. 43 is a longitudinal sectional view taken along line 43-43 of FIG. 42.

Referring to FIG. 42 and FIG. 43, a structure of the disc valve 35 according to the present embodiment is the same as that of the disc valve 35 according to the previous embodiment disclosed in FIGS. 34 and 35, but there is a difference in a structure of the flap portion 352.

In addition, in a horizontal portion 351*b* of the disc valve 35 according to the present embodiment, a plurality of protrusion portions 351*e* and depression portions 351*f* described in the previous embodiment are not shown. However, it is noted that the plurality of protrusion portions 351*e* and the depression portions 351*f* may be applied to the present embodiment as well. Conversely, the plurality of protrusion portions 351*e* and the depression portions 351*f* may not be formed in the drawings of FIGS. 34 and 35. That is, it is noted that other configurations of the disc valve 35 except for the flap portion 352 may be designed in the same manner as in the previous embodiment.

Meanwhile, the flap portion 352 of the disc valve 35 according to the present embodiment may include a first flap portion 352*b* and a second flap portion 352*c*.

In detail, the first flap portion 352*b* may be understood to correspond to the flap portion 352 disclosed in FIGS. 34 and 35, and it may be understood that the second flap portion 352*c* is further extended from the first flap portion 352*b*.

In addition, an inclination of the second flap portion 352*c* may be designed to be different from that of the first flap portion 352*b*. In detail, an inclination angle δ1 formed by the first flap portion 352*b* and a horizontal plane passing through an end portion of the first flap portion 352*b* may be formed to be larger than an inclination angle δ2 formed by the second flap portion 352*c* and a horizontal plane passing through an end portion of the second flap portion 352*c*.

The second flap portion 352*c* extends to be inclined more gently than the first flap portion 352*b*, so that a contact area between the second flap portion 352*c* and a bottom surface of the inner base 14 is widened. As a result, when the piston assembly 29 is not operated, an effect of blocking a flow of a cosmetic solution from a main storage space S1 toward a temporary storage space S2 may be enhanced. In other words, there is an effect that a blocking function of a cosmetic flow path (or flow) of the disc valve 35 is improved.

In more detail, a disc valve applied to the conventional cosmetic container has a structure that opens and closes a flow path of a cosmetic solution at a point spaced upward from a bottom surface of an inner base. As a result, there is a limit in reducing a thickness of the cosmetic container. However, in case of the present invention, since opening and closing points of the flow path of a cosmetic solution are formed at a bottom portion of an inner base, there is an advantage that a thickness of a cosmetic container may be further reduced.

In summary, the fixing portion 151 of the disc valve 15 described in FIG. 23 and the fixing portion 151 of the disc valve 35 described in FIGS. 35 and 42 are designed to be placed outside a moving up and down region of the piston assembly 29, so that the thickness of the cosmetic container may be reduced primarily. Further, the flap portions 152 and 352 of the disc valves 15 and 35 are designed to be selectively in contact with the bottom portion of the inner base 14, so that the thickness of the cosmetic container may be further reduced secondarily.

A point at which the flap portion 152 of the disc valve 15 described in FIG. 23 contacts is actually a part of the bottom portion of the inner base 14, so that it can be seen that the flap portion 152 is also selectively in contact with the bottom portion of the inner base 14.

In addition, the second flap portion 352*c* is further formed, and a pressing area for pushing up the cosmetic solution is increased, and thus there is an advantage that a speed of the cosmetic passing through the outlet 232 of the palette 23 is increased.

FIG. 44 is a partial longitudinal sectional view showing a use state of a cosmetic container in which the piston body and the disc valve described in FIGS. 41 to 43. are mounted.

Referring to FIG. 44, when a user presses the palette 23 by hand, the piston assembly 29 is moved down, and a spacing space is formed between the lower sleeve 181*b* and the lower sleeve contact surface 173.

In addition, the cosmetic solution stored in the temporary storage space S2 is discharged to the outside of the temporary storage space S2 through the spacing space. Thereafter, a pressure in the main storage space S1 is higher than that of the temporary storage space S2, and thus the bottom surface of the flap portion 352 of the disc valve 35 is lifted up from the bottom surface of the inner base 14.

Accordingly, the cosmetic solution pushed into the temporary storage space S2 from the main storage space S1 may largely form two flow paths as indicated by solid arrows.

That is, the two flow paths may include a first flow path that directly passes through the through-hole 172*a* formed in the flange 172 of the piston body 17, and a second flow path that flows upward along the outer edge of the flange 172 to flow into a spacing space formed between the lower sleeve 181*b* and the lower sleeve contact surface 173.

As part of the cosmetic solution flows along the first flow path, it is possible to obtain an effect that a flow resistance is reduced and a flow rate is increased compared with when the through-hole 172*a* is not present.

The inventive features of the cosmetic container according to the embodiment of the present invention described above are summarized as follows.

Example 1

A cosmetic container according to an embodiment of the present invention includes: a base member; a housing including a support sleeve placed on an upper surface of the base member, a center sleeve placed on the upper surface of the base member at an inner center of the support sleeve, a partition plate connecting an upper end of the support sleeve and an upper end of the center sleeve, a main storage space formed between the support sleeve and the center sleeve, and a temporary storage space formed inside the center sleeve; a frame coupled to an upper end of the housing and having a hole of a predetermined size formed therein; a stem coupled to the frame so as to be movable in a vertical direction while being accommodated in the hole and having a discharge port for discharging a cosmetic solution formed in a center thereof; a piston assembly mounted on a bottom surface of the stem and accommodated in the temporary storage space; and a disc valve mounted on a lower end of the center sleeve for selectively communicating the main storage space and the temporary storage space, wherein the disc valve includes a ring-shaped fixing portion, and a flap portion extending from an end portion of one side of the fixing portion and having a predetermined flexibility, the end portion of the flap portion is in contact with a bottom of the base member when the piston assembly moves up, and is separated from the bottom of the base member when the piston assembly moves down.

The flap portion extends from an outer edge or an inner edge of the fixing portion.

The flap portion includes a first flap portion extending from the inner edge of the fixing portion and a second flap portion further extending from an end portion of the flap portion.

An inclination angle of the second flap portion with respect to a horizontal plane is smaller than that of the first flap portion with respect to the horizontal plane.

The piston assembly includes a piston guide and a piston body that passes through the piston guide, has an upper end portion fixed to the bottom surface of the stem, and moves up and down integrally with the stem, wherein the piston body includes a piston sleeve passing through the piston guide and formed with an inlet and an outlet of the cosmetic solution, and a flange extending in a radial direction of the piston sleeve from a lower end of the piston sleeve. wherein a plurality of through-holes are formed in the flange.

The plurality of through-holes are disposed to be spaced apart from each other in the circumferential direction of the flange.

A disc valve coupling portion into which the disc valve is fitted is formed to be recessed at a lower end portion of the center sleeve, and a depression portion and a protrusion are alternately formed at the disc valve coupling portion.

A protrusion portion fitted into the depression portion of the disc valve coupling portion and a depression portion into which the protrusion portion of the disc valve coupling portion is fitted are formed alternately on an upper surface of the fixed portion.

One or a plurality of fitting protrusions protruding from an inner circumferential surface of the fixing portion, and the disc valve coupling portion is formed with a fitting groove into which the one or plurality of fitting protrusions are fitted.

Example 2

A cosmetic container according to an embodiment of the present invention includes: a base member; a housing including a support sleeve placed on an upper surface of the base member, a center sleeve placed on the upper surface of the base member at an inner center of the support sleeve, a partition plate connecting an upper end of the support sleeve and an upper end of the center sleeve, a main storage space formed between the support sleeve and the center sleeve, and a temporary storage space formed inside the center sleeve; a frame coupled to an upper end of the housing and having a hole of a predetermined size formed therein; a stem coupled to the frame so as to be movable in a vertical direction while being accommodated in the hole and having a discharge port for discharging a cosmetic solution formed in a center thereof; a piston assembly mounted on a bottom surface of the stem and accommodated in the temporary storage space; and a disc valve mounted on a lower end of the center sleeve for selectively communicating the main storage space and the temporary storage space, wherein the disc valve includes a ring-shaped fixing portion, and a flap portion extending from an inner edge of the fixing portion and having a predetermined flexibility, a moving up and down region of the piston assembly is defined by a path in which an outer edge of the piston assembly moves in a vertical direction, and at least the fixing portion is placed outside the moving up and down region.

The flap portion extends from an outer edge or an inner edge of the fixing portion.

The flap portion includes a first flap portion extending from the inner edge of the fixing portion and a second flap portion further extending from an end portion of the flap portion.

An inclination angle of the second flap portion with respect to a horizontal plane is smaller than that of the first flap portion with respect to the horizontal plane.

The piston assembly includes a piston guide and a piston body that passes through the piston guide, has an upper end portion fixed to the bottom surface of the stem, and moves up and down integrally with the stem, wherein the piston body includes a piston sleeve passing through the piston guide and formed with an inlet and an outlet of the cosmetic solution, and a flange extending in a radial direction of the piston sleeve from a lower end of the piston sleeve. wherein a plurality of through-holes are formed in the flange.

The plurality of through-holes are disposed to be spaced apart from each other in the circumferential direction of the flange.

A disc valve coupling portion into which the disc valve is fitted is formed to be recessed at a lower end portion of the center sleeve, and a depression portion and a protrusion are alternately formed at the disc valve coupling portion.

A protrusion portion fitted into the depression portion of the disc valve coupling portion and a depression portion into which the protrusion portion of the disc valve coupling portion is fitted are formed alternately on an upper surface of the fixed portion.

One or a plurality of fitting protrusions protruding from an inner circumferential surface of the fixing portion, and the disc valve coupling portion is formed with a fitting groove into which the one or plurality of fitting protrusions are fitted.

What is claimed is:

1. A cosmetic container comprising:

a base member;

a housing including a support sleeve placed on an upper surface of the base member, a center sleeve placed on the upper surface of the base member at an inner center of the support sleeve, a partition plate connecting an upper end of the support sleeve and an upper end of the center sleeve, a main storage space formed between the support sleeve and the center sleeve, and a temporary storage space formed inside the center sleeve;

a frame coupled to an upper end of the housing and having a hole of a predetermined size formed therein;

a stem coupled to the frame so as to be movable in a vertical direction while being accommodated in the hole and having a discharge port for discharging a cosmetic solution formed in a center thereof;

a piston assembly mounted on a bottom surface of the stem and accommodated in the temporary storage space; and a disc valve mounted on a lower end of the center sleeve for selectively communicating the main storage space and the temporary storage space, wherein the disc valve includes:

a ring-shaped fixing portion; and a flap portion that extends from an end portion of one side of the fixing portion, and wherein at least the fixing portion of the disc valve is disposed outside in a lateral direction from the piston assembly, the lateral direction being defined to be crossing with respect to a direction that the piston assembly moves in the vertical direction.

2. The cosmetic container of claim 1, wherein a disc valve coupling portion into which the disc valve is fitted is formed to be recessed at a lower end portion of the center sleeve, and wherein a depression portion and a protrusion portion are alternately formed at the disc valve coupling portion.

3. The cosmetic container of claim 2, wherein a protrusion portion fitted into the depression portion of the disc valve coupling portion and a depression portion into which the protrusion portion of the disc valve coupling portion is fitted are formed alternately on an upper surface of the fixing portion.

4. The cosmetic container of claim 3, wherein the flap portion is formed more flexible than the fixing portion.

5. The cosmetic container of claim 4, wherein the flap portion extends obliquely from an inner edge of the fixing portion towards a center of a bottom surface of the base member, and wherein the flap portion includes:

a first flap portion extending from the fixing portion; and a second flap portion extending from an end of the first flap portion.

6. The cosmetic container of claim 5, wherein inclinations of the first flap portion and the second flap portion are designed to be different from each other.

7. The cosmetic container of claim 6, wherein an acute angle formed by the first flap portion and a horizontal plane passing through the end of the first flap portion is formed to be larger than an acute angle formed by the second flap portion and a horizontal plane passing through an end of the second flap portion.

8. The cosmetic container of claim 4, wherein the flap portion is bent and extends downward from an outer end portion of the fixing portion, wherein disc valve further includes one or a plurality of fitting protrusions protruding from an inner circumferential surface of the fixing portion, and wherein the disc valve coupling portion is formed with a fitting groove into which the one or plurality of fitting protrusions are fitted.

9. The cosmetic container of claim 8, wherein the base member includes a bottom portion in which a depression portion having a predetermined depth is formed in a central portion thereof, and a side surface portion extending upward from an outer edge of the bottom portion, and wherein an outer circumferential surface of the flap portion is selectively in close contact with a locking protrusion that connects the bottom portion of the base member to the depression portion of the base member.

10. The cosmetic container of claim 9, further comprising a plurality of guide protrusions protruding from the bottom portion of the base member, but disposed to be spaced along an edge of the depression portion of the base member, wherein an inner surface of the guide protrusion is formed to be inclined so that the flap portion is guided toward the depression portion of the base member during assembly.

11. The cosmetic container of claim 1, further comprising a gasket placed on an upper surface of the stem.

12. The cosmetic container of claim 11, wherein a discharge port for discharging the cosmetic solution is formed at a center of the stem, and wherein a gasket placing groove on which the gasket is placed is formed on the upper surface of the stem.

13. The cosmetic container of claim 12, wherein a guide flow path for guiding a flow of the cosmetic solution discharged through the discharge port is formed to be recessed in the upper surface of the stem corresponding to an inside of the gasket placing groove.

14. The cosmetic container of claim 13, further comprising a palette placed on the upper surface of the stem, wherein a plurality of outlets are formed in the palette, and wherein the plurality of outlets are formed along the guide flow path in a state in which the palette is placed on the stem.

15. The cosmetic container of claim 13, wherein the guide flow path includes:

a first flow path including a plurality of circular flow paths having different diameters around the discharge port; and a second flow path including a plurality of straight flow paths dividing the first flow path through the discharge port.

16. The cosmetic container of claim 1, wherein the partition plate is formed of a metal material, and wherein the support sleeve and the center sleeve are formed of plastic materials that are coupled to an outer edge and an inner edge of the partition plate, respectively.

17. The cosmetic container of claim 1, further comprising:

an outer cover rotatably coupled to the base member by a hinge shaft;

a pressure member mounted on a side surface portion of the outer cover;

a locking protrusion formed on a side surface portion of the outer cover corresponding to an opposite side of the pressure member; and a push button mounted on the base member at a position aligned with the locking protrusion and having a locking hook selectively coupled with the locking protrusion, wherein the pressure member presses an outer circumferential surface of the base member at a point spaced apart from the hinge shaft.

18. The cosmetic container of claim 17, wherein when the locking protrusion is separated from the locking hook, the outer cover is rotated by a rotation moment generated around the hinge shaft by a restoring force accumulated in the pressure member.

19. The cosmetic container of claim 1, wherein the piston assembly includes a piston guide, and a piston body that passes through the piston guide, has an upper end portion fixed to the bottom surface of the stem, and moves in the vertical direction integrally with the stem, wherein the piston body includes a piston sleeve passing through the piston guide and formed with an inlet and outlet of the cosmetic solution, and a flange extending in a radial direction of the piston sleeve from a lower end of the piston sleeve, and wherein a plurality of through-holes are formed in the flange.

* * * * *